US010276969B2

(12) United States Patent
Campbell

(10) Patent No.: US 10,276,969 B2
(45) Date of Patent: Apr. 30, 2019

(54) CONNECTOR WITH SEALING BOOT AND MOVEABLE SHUTTLE

(71) Applicant: ITT Manufacturing Enterprises LLC, Wilmington, DE (US)

(72) Inventor: Charles Campbell, Santa Rosa, CA (US)

(73) Assignee: ITT Manufacturing Enterprises LLC, Wilmington, DE (US)

( * ) Notice: Subject to any disclaimer, the term of this patent is extended or adjusted under 35 U.S.C. 154(b) by 0 days.

(21) Appl. No.: 15/948,156

(22) Filed: Apr. 9, 2018

(65) Prior Publication Data

US 2018/0309228 A1 Oct. 25, 2018

Related U.S. Application Data

(63) Continuation-in-part of application No. 15/493,055, filed on Apr. 20, 2017, now Pat. No. 9,941,622.

(51) Int. Cl.

| | |
|---|---|
| ***H01R 13/52*** | (2006.01) |
| ***H01R 43/20*** | (2006.01) |
| ***H01R 13/00*** | (2006.01) |
| ***H01R 13/533*** | (2006.01) |

(52) U.S. Cl.

CPC ..... *H01R 13/5208* (2013.01); *H01R 13/005* (2013.01); *H01R 13/533* (2013.01); *H01R 43/20* (2013.01)

(58) Field of Classification Search

CPC ..... H01R 13/5205; H01R 13/5208; H01R 13/005; H01R 13/533

USPC ..... 439/274, 275

See application file for complete search history.

(56) References Cited

U.S. PATENT DOCUMENTS

| | | | |
|---|---|---|---|
| 1,328,612 | A | 1/1920 | Becker |
| 1,769,101 | A | 7/1930 | Becker |
| 2,105,182 | A | 1/1938 | Church |
| 2,161,694 | A | 6/1939 | Becker |
| 2,209,620 | A | 7/1940 | Berndt |
| 3,641,479 | A | 2/1972 | O'Brien et al. |
| 3,652,777 | A | 3/1972 | Elliott |
| 3,729,699 | A | 4/1973 | Briggs et al. |
| 3,877,775 | A | 4/1975 | Barlow et al. |
| 4,080,025 | A | 3/1978 | Garnier et al. |
| 4,105,279 | A | 8/1978 | Glotin et al. |

(Continued)

FOREIGN PATENT DOCUMENTS

| | | |
|---|---|---|
| CN | 101976782 | 2/2011 |
| EP | 0 637 675 | 2/1995 |

(Continued)

*Primary Examiner* — Ross N Gushi

(74) *Attorney, Agent, or Firm* — Knobbe, Martens, Olson & Bear LLP

(57) ABSTRACT

Various connectors are disclosed. The connectors include a sealing assembly for providing a seal around a cable extending through the connector. The sealing assembly can include a moveable shuttle, a stop component, and a sealing boot. The sealing boot can be compressed between the stop component and the shuttle, such as a sleeve of the shuttle. The sealing boot can be configured to change shape (e.g., buckle) around the cable in response to movement of the shuttle. The change in shape of the sealing boot can facilitate sealing around the cable. The connector can be configured to inhibit or prevent the sealing boot from being extruded out of position in response to a pressure gradient between first and second ends of the connector.

22 Claims, 20 Drawing Sheets

(56) References Cited

U.S. PATENT DOCUMENTS

| | | | |
|---|---|---|---|
| 4,142,770 | A | 3/1979 | Butler, Jr. et al. |
| 4,174,875 | A | 11/1979 | Wilson et al. |
| 4,390,229 | A | 6/1983 | Chevalier |
| 4,488,765 | A | 12/1984 | Erbe |
| 4,500,151 | A | 2/1985 | Ayers |
| 4,500,156 | A | 2/1985 | Nguyen |
| 4,515,426 | A | 5/1985 | Bager |
| 4,561,679 | A | 12/1985 | Choate |
| 4,589,717 | A | 5/1986 | Pottier et al. |
| 4,614,392 | A | 9/1986 | Moore |
| 4,752,252 | A | 6/1988 | Cherry et al. |
| 4,767,349 | A | 8/1988 | Pottier et al. |
| 4,780,574 | A | 10/1988 | Neuroth |
| 4,797,117 | A | 1/1989 | Ayers |
| 4,859,196 | A | 8/1989 | Durando et al. |
| 4,880,390 | A | 11/1989 | Brackmann, Jr. et al. |
| 4,940,416 | A | 7/1990 | Wagaman et al. |
| 4,948,377 | A | 8/1990 | Cairns |
| 5,017,160 | A | 5/1991 | Garcia |
| 5,059,139 | A | 10/1991 | Spinner |
| 5,334,032 | A | 8/1994 | Myers et al. |
| 5,344,337 | A | 9/1994 | Ritter |
| 5,435,745 | A | 7/1995 | Booth |
| 5,443,328 | A | 8/1995 | Alcock et al. |
| 5,458,507 | A | 10/1995 | Colescott et al. |
| 5,573,423 | A | 11/1996 | Lin et al. |
| 5,642,780 | A | 7/1997 | Moore |
| 5,645,442 | A | 7/1997 | Cairns |
| 5,683,273 | A | 11/1997 | Garver et al. |
| 5,760,334 | A | 6/1998 | Ziemek |
| 5,863,220 | A | 1/1999 | Holliday |
| 5,868,554 | A | 2/1999 | Giacomino et al. |
| 5,899,765 | A | 5/1999 | Niekrasz et al. |
| 5,907,128 | A | 5/1999 | Lanan et al. |
| 5,975,939 | A | 11/1999 | Market |
| 6,027,373 | A | 2/2000 | Gray et al. |
| 6,168,455 | B1 | 1/2001 | Hussaini |
| 6,200,152 | B1 | 3/2001 | Hopper |
| 6,261,126 | B1 | 7/2001 | Stirling |
| 6,326,550 | B1 | 12/2001 | Dyer et al. |
| 6,341,979 | B1 | 1/2002 | Yamamoto |
| 6,559,383 | B1 | 5/2003 | Martin |
| 6,780,037 | B1 | 8/2004 | Parmeter et al. |
| 6,796,821 | B2 | 9/2004 | Cairns et al. |
| 6,832,924 | B2 | 12/2004 | Maletzki et al. |
| 6,848,939 | B2 | 2/2005 | Stirling |
| 6,916,193 | B2 | 7/2005 | Varreng et al. |
| 6,932,636 | B2 | 8/2005 | Abbey et al. |
| 7,080,998 | B2 | 7/2006 | Hall et al. |
| 7,112,080 | B2 | 9/2006 | Nicholson |
| 7,160,156 | B2 | 1/2007 | Holliday |
| 7,367,848 | B2 | 5/2008 | John |
| 7,425,153 | B1 | 9/2008 | Miller, Jr. |
| 7,455,541 | B2 | 11/2008 | Jackson et al. |
| 7,467,979 | B2 | 12/2008 | Colescott et al. |
| 7,473,129 | B2 | 1/2009 | Jackson et al. |
| 7,528,513 | B2 | 5/2009 | Oh |
| 7,533,461 | B2 | 5/2009 | Griffiths |
| 7,695,301 | B2 | 4/2010 | Mudge, III et al. |
| 7,737,361 | B2 | 6/2010 | Huspeni et al. |
| 7,752,918 | B2 | 7/2010 | Davis |
| 7,767,908 | B2 | 8/2010 | Sylvan |
| 7,806,708 | B2 | 10/2010 | Erstad |
| 7,828,573 | B2 | 11/2010 | Butaud |
| 7,901,240 | B2 | 3/2011 | Jackson et al. |
| 7,942,696 | B2 | 5/2011 | Watson |
| 7,955,105 | B2 | 6/2011 | Maeland |
| 7,959,454 | B2 | 6/2011 | Ramasubramanian et al. |
| 8,025,506 | B2 | 9/2011 | Cairns |
| 8,083,544 | B2 | 12/2011 | Chee |
| 8,172,612 | B2 | 5/2012 | Bence et al. |
| 8,246,371 | B2 | 8/2012 | Emerson |
| 8,288,667 | B2 | 10/2012 | Chiou |
| 8,297,345 | B2 | 10/2012 | Emerson |
| 8,382,508 | B1 | 2/2013 | Frey et al. |
| 8,398,420 | B2 | 3/2013 | Watson |
| 8,512,074 | B2 | 8/2013 | Frey |
| 8,702,456 | B1 | 4/2014 | Wang |
| 8,734,175 | B2 | 5/2014 | Ayers |
| 8,747,151 | B2 | 6/2014 | Sutter |
| 8,816,196 | B2 | 8/2014 | Williams et al. |
| 8,816,197 | B2 | 8/2014 | Campbell et al. |
| 9,160,097 | B2 | 10/2015 | Mori |
| 9,376,884 | B2 | 6/2016 | Clarke |
| 9,455,526 | B2 | 9/2016 | Morby et al. |
| 9,673,558 | B2 | 6/2017 | Frey et al. |
| 9,843,113 | B1 | 12/2017 | Campbell |
| 9,941,622 | B1 | 4/2018 | Campbell |
| 2002/0046865 | A1 | 4/2002 | Bertini et al. |
| 2003/0148638 | A1 | 8/2003 | McHugh et al. |
| 2003/0172743 | A1 | 9/2003 | Ao et al. |
| 2004/0118590 | A1 | 6/2004 | Head |
| 2004/0211586 | A1 | 10/2004 | Sinha et al. |
| 2004/0262025 | A1 | 12/2004 | Brandt et al. |
| 2005/0056456 | A1 | 3/2005 | Ladie et al. |
| 2005/0189130 | A1 | 9/2005 | Bertini et al. |
| 2007/0010119 | A1 | 1/2007 | Hall et al. |
| 2007/0015406 | A1 | 1/2007 | Chawgo |
| 2007/0040459 | A1 | 2/2007 | Oh |
| 2007/0155232 | A1 | 7/2007 | Burris et al. |
| 2007/0169954 | A1 | 7/2007 | Bertini et al. |
| 2009/0065237 | A1 | 3/2009 | Evoniuk et al. |
| 2009/0233482 | A1 | 9/2009 | Chawgo et al. |
| 2011/0130024 | A1 | 6/2011 | Cairns |
| 2011/0306225 | A1 | 12/2011 | Chaize |
| 2012/0097444 | A1 | 4/2012 | Hilberts et al. |
| 2012/0100738 | A1 | 4/2012 | Palinkas et al. |
| 2012/0149227 | A1 | 6/2012 | Yoshida |
| 2012/0329311 | A1 | 12/2012 | Duval et al. |
| 2013/0183003 | A1 | 7/2013 | Cairns |
| 2013/0206474 | A1 | 8/2013 | Skrypka et al. |
| 2013/0312996 | A1 | 11/2013 | Nicholson |
| 2014/0096992 | A1 | 4/2014 | Williams et al. |
| 2014/0097001 | A1 | 4/2014 | Campbell et al. |
| 2014/0099812 | A1 | 4/2014 | Burrow et al. |
| 2014/0370735 | A1 | 12/2014 | Nicholson |
| 2015/0031227 | A1 | 1/2015 | Morby et al. |
| 2015/0111420 | A1 | 4/2015 | Zillinger et al. |
| 2015/0200471 | A1 | 7/2015 | Melni |
| 2015/0315877 | A1 | 11/2015 | Hamilton-Gahart et al. |
| 2015/0325943 | A1 | 11/2015 | Frey et al. |
| 2016/0211052 | A1 | 7/2016 | Williams et al. |

FOREIGN PATENT DOCUMENTS

| | | |
|---|---|---|
| EP | 0 902 505 | 3/1999 |
| EP | 2 386 714 | 11/2011 |
| WO | WO 02/103854 | 12/2002 |
| WO | WO 2008/113026 | 9/2008 |
| WO | WO 2009/097609 | 8/2009 |

CONNECTOR WITH SEALING BOOT AND MOVEABLE SHUTTLE

CROSS-REFERENCE

This application is a continuation-in-part of U.S. patent application Ser. No. 15/493,055, filed Apr. 20, 2017, the entirety of which is hereby incorporated by reference.

BACKGROUND

Field

This disclosure relates to connectors, such as electrical connectors. In some embodiments, this disclosure relates to devices, systems, and methods for providing a fluid, pressure, or other type of seal, within a connector.

Description of Certain Art

Connectors are used in a wide variety of applications. As one example, an electrical connector can be used to join an electrical conductor of a cable or wire to another electrical conductor of another cable or wire to establish an electrical circuit for transmission of power, data, or other signals between the two electrical conductors. As other examples, pneumatic or hydraulic connectors can be used to connect a pneumatic or hydraulic line or hose to another pneumatic or hydraulic line or hose to establish a fluid connection between the two lines or hoses.

SUMMARY OF CERTAIN FEATURES

This application describes various connectors. In some embodiments, the connectors are electrical connectors that are configured to join an electrical conductor to another electrical conductor to establish an electrical circuit for transmission of power, data, or other signals between the two electrical conductors. In some embodiments, the connectors are used to facilitate other types of connections, such as hydraulic or pneumatic connections. In some embodiments, the connectors are configured for use in harsh environments, such as within the downhole environment of a well. In certain embodiments, the connectors can be configured to withstand harsh conditions, such as high and/or low temperatures and pressures, large fluctuations in temperature and pressure, exposure to fluids (including corrosive fluids), and/or exposure to abrasive particles.

In some embodiments, the connectors include a housing. One or more conduits, wires, or cables (such as electrical wires or cables, hydraulic or pneumatic lines or hoses, etc.) can extend into an interior of the housing. The cables can connect to a receptacle assembly within the interior of the housing. In some embodiments, the receptacle assembly extends through the housing such that at least a portion of the receptacle assembly is external to the housing. The receptacle assembly can include a socket, plug, or other connection structure. The socket, plug, or other connection structure can be positioned on an external portion of the receptacle assembly. The socket, plug, or other connection structure can be configured to attach the connector to another system or device, such as another connector. The connectors can be configured to establish a connection between the cables and the receptacle assembly, and the receptacle assembly can be used to attach the connector to another system or device to establish a connection between the cables and the other system or device.

In some embodiments, the connectors include a sealing assembly. The sealing assembly can be configured to create a seal that prevents, substantially prevents, reduces, substantially reduces, limits, or substantially limits the movement of liquid, gases, particles, debris, dust or other things across the seal and/or through the connector. In some embodiments, the sealing assembly creates a pressure seal and/or a liquid seal. In some embodiments, the sealing assembly creates a seal around the cables that extend into and/or through the housing. In some embodiments, the sealing assembly creates a seal between the exterior of the connector and the receptacle assembly. The sealing assembly can be positioned within the interior of the housing. The sealing assembly can be positioned between a point at which the cables enter the interior of the housing and the receptacle assembly. The cables can extend through the sealing assembly.

In some embodiments, the sealing assembly includes a shuttle. The shuttle can include one or more bores extending longitudinally or axially therethrough. The bores can be parallel. The number of bores can correspond to the number of cables. Each cable can extend through one of the bores of the shuttle. The shuttle can be configured to move backwards and forwards (in a longitudinal or axial direction) along the cables.

In certain implementations, the sealing assembly includes one or more sealing boots. A sealing boot can be positioned within some or each of the bores of the shuttle. The sealing boot can comprise a body having a channel formed therethrough. The channel of the sealing boot can receive one of the cables. Each sealing boot can be positioned within a respective bore of the shuttle. The number of sealing boots can correspond to the number of bores and the number of cables. The sealing boots can be made from a rubber, elastomeric, or other similar or suitable material.

The body of the sealing boots can be configured to collapse or buckle when the sealing boot is compressed in a longitudinal or axial direction. For example, in some embodiments, when compressed in the longitudinal or axial direction, the length of the sealing boots decreases, the outside diameter of the body of the sealing boots increases and/or the inside diameter of the channel of the sealing boots decreases. In some embodiments, the sealing boots are configured to collapse around and/or form a seal against the cables when compressed. In some embodiments, an outer surface of the sealing boots has a jagged, wavy, discontinuous, and/or accordion-like profile to facilitate collapsing of the sealing boots.

In some embodiments, the length of the sealing boots is less than the length of the bores of the shuttle, such that the sealing boots can be positioned entirely within the bores of the shuttle. The sealing boots can surround the cables at a location that is internal to the shuttle. The bores of the shuttle can each include a shoulder. A first end of each of the sealing boots can engage (e.g., abut against) the shoulder within the bores. The shoulder can be configured such that longitudinal or axial movement of the shuttle can apply a longitudinal or axial force to the first end of each of the sealing boots.

The sealing assembly can include one or more sleeves. The number of sleeves can correspond to the number of sealing boots, the number of bores, and the number of cables. The sleeve can comprise a body having an aperture formed therethrough. The aperture can receive one of the cables. The body of the sleeve can be substantially rigid. In some embodiments, the body of the sleeve does not substantially compress under longitudinal or axial forces. A first end of the sleeve can be positioned within one of the bores of the shuttle. In some embodiments, a portion of each sleeve extends at least partially into a corresponding bore of the shuttle. The first end of the sleeve can engage (e.g., abut against) a second end of a corresponding sealing boot. In the longitudinal or axial direction, each of the sealing boots can be positioned between a corresponding sleeve and a corresponding shoulder of a bore of the shuttle.

In some variants, a second end of the sleeve engages (e.g., abuts against or is fixed within) a stop component. The stop component can be substantially fixedly positioned within the housing. The stop component can be configured to substantially limit or prevent movement of the sleeve in an axial or longitudinal direction. The stop component can include one or more openings, the cables extending therethrough.

In some embodiments, when the shuttle moves in the longitudinal direction towards the stop component, the sealing boot can be longitudinally compressed between the sleeve and shoulder. This can cause the boot to collapse around the cables, thereby forming a seal around the cable.

The sealing assembly can include a biasing member (e.g., a spring). The spring can be positioned within the housing. The spring can bias the shuttle in the longitudinal or axial direction towards the stop component.

In certain implementations, instead of or in addition to being placed within the shuttle, the sealing boots can be positioned within some or each of openings within the shuttle and the sleeves can extend from the shuttle. With the sealing boots be positioned within an opening of the stop component, the sleeves can extend into the opening to engage the sealing boots. Movement of the shuttle (e.g., by the biasing member) towards the stop component can carry the sleeves into contact with the sealing boots and compress or buckle the sealing boots and thereby creating a seal between the stop component and the cable within the opening. The number of sealing boots can correspond to the number of openings and the number of cables. The sealing boots can be made from a rubber, elastomeric, or other similar or suitable material.

As mentioned above, in some embodiments, the connectors are configured for use in harsh environments. Several embodiments of the connectors are configured to be subjected to high and/or low temperatures and pressures, large fluctuations in temperature and pressure, exposure to fluids (e.g., corrosive fluids), and/or exposure to abrasive particles. Several embodiments are configured for use with a large pressure gradient between one end of the connector and the other end of the connector. For example, some embodiments are configured for use with a pressure gradient of up to about 3,000 psi. Certain variants are configured for use with a pressure gradient of up to about 5,000 psi. In several embodiments, the connectors can provide a seal, such as around the cables. The seal can inhibit or prevent pressure from one end of the connector (e.g., at well pressure) from being transferred to the other end of the connector (e.g., at approximately atmospheric pressure).

As connectors are exposed to a range of temperatures and pressures, the components of the connectors are subjected to varying forces and thermal expansion and contraction. The components of the connectors may be made from materials that have different and varied thermal expansion coefficients and thus may expand or contract to different degrees and/or at different rates. For example, several of the components may be made from metals, alloys, or other similar materials, while other components may be made from rubbers, elastomers or other similar materials; the thermal expansion coefficient between these components may vary dramatically, for example, by a factor of ten. Accordingly, it can be difficult to maintain effective sealing over a range of pressures and temperatures, since seals that function at one pressure and temperature may not function well at another pressure and temperature. In some embodiments, the connectors include a moveable shuttle and collapsible sealing boots. When certain embodiments of the connectors are exposed to a range of pressures and temperatures, and the components experience varying forces and thermal expansion, the shuttle can move and the sealing boots can collapse or buckle around the cables to different positions and degrees. This can enable the connector to automatically adjust for changes in the pressure and/or to maintain an efficient seal around the cables in a variety of situations.

In some embodiments, the connectors can be configured to compensate for changes in temperature. As described above, the components of connectors expand and contract at different rates due to the different thermal expansion coefficient of the components and/or varying other forces on the components. In some known connectors, this can cause the sealing or contact pressure of seals within the connectors to vary widely. In some instances, the sealing or contact pressure can increase to a degree that it damages the cables around which the seals are formed. In certain embodiments, the connectors can remedy such problems, such as with the moveable shuttle and collapsible sealing boots. In response to a change in temperature and/or pressure, the shuttle can move and the sealing boots can collapse or buckle to different positions and/or different degrees. This can enable the connectors to automatically compensate for changes in temperature. In some implementations, the connectors can maintain a relatively constant sealing or contact pressure on the cables. In some embodiments, the connectors can provide a seal around the cables without damaging the cables over a wide range of temperatures and/or pressures.

According to certain embodiments, the connectors can be configured to prevent or reduce the likelihood that the rubber or elastomeric sealing components will be extruded out from their positions or otherwise damaged by pressure differentials to which the connectors are exposed. As stated above, the components of connectors expand and contract to different degrees and different rates due to the different coefficients of thermal expansion of the materials used and/or are acted on by varying other forces, such as pressure gradients. In some known connectors, a rubber or elastomeric sealing component can be positioned in a gap, such as an annular space between mating components. As the components expand and contract, or are moved by other forces, the size of the gap may vary. The gap may become sufficiently large that a pressure differential can extrude or force the rubber or elastomeric sealing component through the gap. When this occurs, the sealing component may no longer provide an effective seal and can be damaged or destroyed. In several embodiments, the connectors disclosed herein are configured to maintain an effective seal even when subjected to large pressure gradients.

As mentioned above, in some embodiments, the connectors include sealing assemblies having rubber or elastomeric sealing boots. The sealing boots can be positioned within a bore of a shuttle and between a shoulder of the bore and a sleeve that extends partially into the bore. The sleeve and the shuttle can be made from materials with substantially the same or the same coefficients of expansion such that the sleeve and shuttle expand and contract to similar degrees and at similar rates. In various embodiments, a gap between the sleeve and the shuttle may remain substantially constant in size and/or proportion, even as these components expand and contract. This can prevent or reduce the likelihood that the sealing boot will be extruded or forced through the gap between the sleeve and the shuttle. In several embodiments, the sealing boot can be collapsible such that an outer diameter of the sealing boot can increase (as the sealing boot collapses or buckles). Such a change in the outer diameter of the sealing boot can prevent or reduce the likelihood that the sealing boot will be extruded or forced through the gaps between the sleeve and the shuttle.

In certain embodiments, the connectors can advantageously be used with cables of different sizes or diameters. As previously stated, the connectors can include collapsible sealing boots. In some embodiments, the inner diameter of a channel through the sealing boot decreases as the sealing boot collapses or buckles. This can enable the sealing boot to provide a seal around a variety of cable sizes. This can be particularly advantageous because cables of similar gauges may have varying outside diameters, depending, for example, on the thickness of various internal surrounding and/or protective layers of the cables and/or the particular manufacturer of the cables. Some known connectors are typically designed for use with specific gauge cables, but can fail to provide efficient seals (even when used with the specified gauge) due to small differences between cables provided by different manufacturers. In some embodiments, the connectors can readily adapt to various cable sizes so that the connectors can be used with various cables, regardless of cable manufacturer.

The foregoing is a summary and contains simplifications, generalization, and omissions of detail. The summary is illustrative only and is not intended to be limiting. Other aspects, features, and advantages of the systems, devices, and methods and/or other subject matter described in this application will become apparent in the teachings set forth below. The summary is provided to introduce a selection of some of the concepts in a simplified form that are further described below in the Detailed Description. The summary is not intended to identify key or essential features of any subject matter described herein.

BRIEF DESCRIPTION OF THE DRAWINGS

The features and advantages of the systems, devices, and methods of the connectors described herein will become apparent from the following description, taken in conjunction with the accompanying drawings. These drawings depict several embodiments in accordance with the disclosure. The drawings are not to be considered limiting. In the drawings, similar reference numbers or symbols typically identify similar components, unless context dictates otherwise.

DETAILED DESCRIPTION OF CERTAIN EMBODIMENTS

The various features and advantages of the systems, devices, and methods of the connectors described herein will become more fully apparent from the following description of the several specific embodiments illustrated in the figures. These embodiments are intended to illustrate the principles of this disclosure, and this disclosure should not be limited to merely the illustrated examples. The features of illustrated embodiments can be modified, combined, removed, and/or substituted as will be apparent to those of ordinary skill in the art upon consideration of the principles disclosed herein.

Overview (FIGS. 1A-3)

Figure 1A:
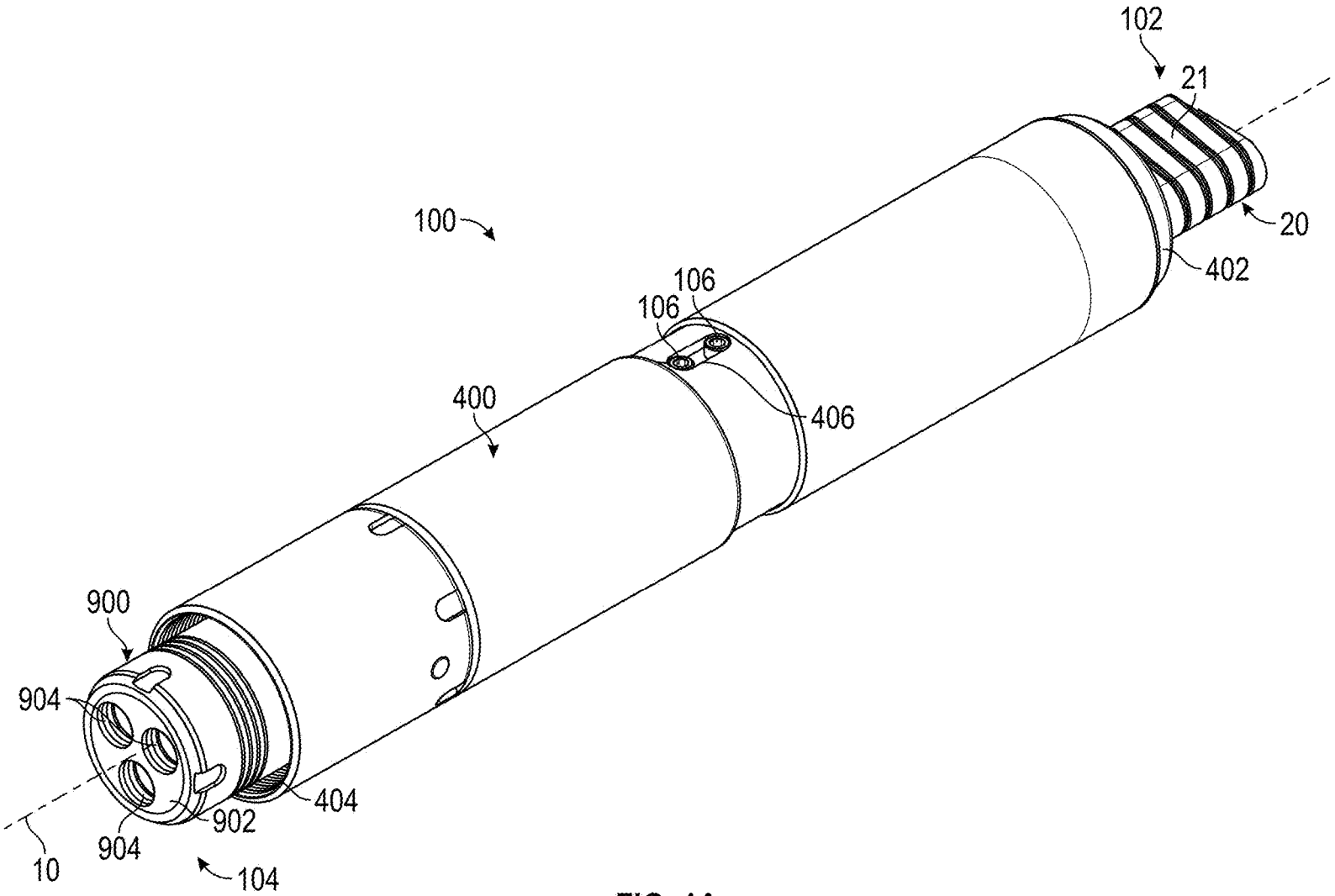
FIG. 1A is an isometric view of an embodiment of a connector.

FIG. 1A illustrates an embodiment of a connector 100. The connector 100 can be any type of connector, including an electrical connector, a hydraulic connector, a pneumatic connector, or other type of connector. In the illustrated embodiment, the connector 100 is an electrical connector. The connector 100 has a first end 102 and a second end 104 and extends generally along an axis 10. The axis 10 extends in a longitudinal (also referred to as an axial) direction.

In some instances, the connector 100 can be used in harsh environments. As one example, in the oil and gas industry, the connector 100 can be used to connect to equipment (such as an electric submersible pump (ESP)) within a well. The connector 100 can be used for delivery of power and/or data to the ESP. The downhole environment of a well can be particularly harsh, experiencing high and/or low temperatures and pressures, large fluctuations in temperature and pressure, exposure to fluids (including corrosive fluids), and exposure to abrasive particles.

The connector 100 includes a housing 400. The housing 400 can be substantially or generally cylindrical, although other shapes are possible. The housing 400 extends between a first end 402 and a second end 404. The housing 400 is shown in greater detail in FIGS. 4A and 4B, which are described below.

A cable bundle 20 can extend into the interior of the housing 400 through the first end 402 of the housing 400 at the first end 102 of the connector 100. In certain embodiments, the cable bundle 20 can include a first cable 22, a second cable 24, and a third cable 26, as shown, for example, in FIGS. 1B and 2. In the illustrated embodiment, the one or more cables 22, 24, 26 are electrical wires or cables that include an electrical conductor for transmitting power, data, or another electrical signal. In some embodiments, the connector 100 is configured to connect and deliver power to a three-phase motor, and each of three conduits (the first cable 22, the second cable 24, and the third cable 26) corresponds to one phase of the motor. In some embodiments, the three-phase motor is part of an ESP. In some embodiments, the one or more cables 22, 24, 26 can include hydraulic or pneumatic hoses or lines. In some embodiments, other numbers of cables 22, 24, 26 can be included. For example, the connector 100 can be used with one, two, three, four, five, six, seven, eight or cables 22, 24, 26. In some embodiments, the cable bundle 20 includes only a single cable. The cable bundle 20 and/or the one or more cables 22, 24, 26 can be protected by a flexible sheath 21. Only a portion of the cable bundle 20, the cables 22, 24, 26, and the sheath 21 are illustrated in FIG. 1A. The connector 100 can be used with a cable bundle 20 and/or one or more cables 22, 24, 26 of any length. The sheath 21 can extend over any portion of the length of the cable bundle 20 and/or the one or more cables 22, 24, 26.

The connector 100 includes a receptacle assembly 900. The receptacle assembly 900 can be positioned at the second end 104 of the connector 100. As shown, a portion of the receptacle assembly 900 extends outwardly from the second end 404 of the housing 400. The receptacle assembly 900 includes a socket 902. The socket 902 can be external to the housing 400. In the illustrated embodiment, the socket 902 includes three holes 904. Each hole 904 can be configured to receive a pin or plug on a corresponding connector (not shown). In some embodiments, each hole 904 corresponds to one of the first cable 22, the second cable 24, and the third cable 26 such that an electrical connection can be established with the first cable 22, the second cable 24, and the third cable 26 through the corresponding hole 904. The receptacle assembly 900 and the socket 902 are configured to allow the connector 100 to connect to a corresponding connector or other structure. Although the receptacle assembly 900 is illustrated with a female socket 902, other structures can also be used. For example, the receptacle assembly 900 can include a male plug. In some embodiments, the connector 100 includes a cap (not shown) that can be installed over the exposed end of the receptacle assembly 900. The cap can protect the receptacle assembly 900 when the receptacle assembly 900 is not connected to another connector. The receptacle assembly 900 is described in greater detail with reference to FIGS. 9A-9C below.

Figure 1B:
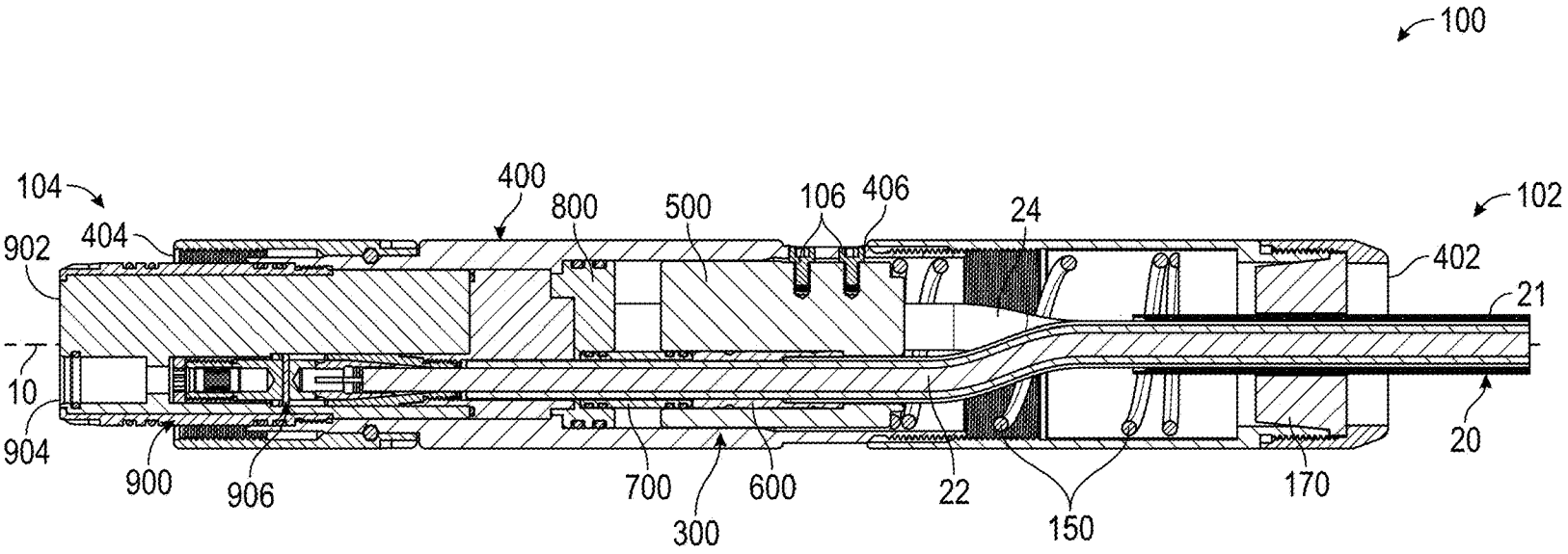
FIG. 1B is a longitudinal cross-sectional view of the connector of FIG. 1A.

Although not shown in FIG. 1A, the connector 100 can include a sealing assembly 300 positioned within the housing 400 (see, for example, FIGS. 1B and 1C). As will be described in greater detail below, the sealing assembly 300 can include a moveable shuttle 500 that is configured to move back and forth longitudinally along the axis 10 within the housing 400. As shown in FIG. 1A, the connector 100 can include one or more set screws 106. In the illustrated embodiment, two set screws 106 are included. The set screws 106 can extend partially through an opening or slot 406 formed through the housing 400 and into the shuttle 500. When installed, the set screws 106 may inhibit or prevent the shuttle 500 from moving within the housing 400. In some embodiments, one of the set screws 106 can be removed to provide a configuration that partially limits the movement of the shuttle 500 within the housing 400. For example, in some embodiments, with only a single set screw 106 installed, the movement of the shuttle 500 is limited to approximately the length of the slot 406. The shuttle 500 is described in greater detail below.

As shown in FIG. 1B, the cable bundle 20 (including the first cable 22 and the second cable 24, which are visible in FIG. 1B (the third cable 26 is not visible in this view)) extend through the first end 402 of the housing 400 and into the interior of the connector 100. A ferrule 170 can be positioned in the second end 402 of the housing 400 and the cable bundle 20 can extend through the ferrule 170. In some embodiments, the ferrule 170 is configured to fit tightly around cable bundle 20 or the sheath 21. The ferrule 170 can provide a seal or barrier that prevents, limits, or reduces liquid or particles from entering the interior of the connector 100. In some embodiments, the ferrule 170 comprises a metal, alloy, or other similar or suitable material. In some embodiments, the ferrule 170 comprises a rubber, elastomeric, or other similar or suitable material. The cable bundle 20 and/or the cables 22, 24, 26 extend through the interior of the housing 400 to the receptacle assembly 900. The cables 22, 24, 26 terminate at a connection assembly 906 which provides an electrical connection to the socket 904. The receptacle assembly 900, including the connection assembly 906, is described in greater detail below with reference to FIGS. 9A and 9B.

Within the interior of the housing 400, the cables 22, 24, 26 extend through the sealing assembly 300. The sealing assembly 300 can be positioned between the receptacle assembly 900 and the first end 402 of the housing 400. As will become more apparent from the following description, the sealing assembly 300 can be configured to create a seal around each of the cables 22, 24, 26. The seal can be a liquid seal or a pressure seal. In some embodiment, the seal prevents, substantially prevents, reduces, substantially reduces, limits, or substantially limits the movement of liquid, gases, particles, debris, dust, or other things, across the seal and/or through the connector 100.

As illustrated, the sealing assembly 300 can include a biasing member, such as a spring 150. The spring 150 can be positioned between the first end 402 of the housing 400 and the shuttle 500. The spring 150 can be configured to bias the shuttle 500 toward the stop component 800. The spring 150 can be a linear coil spring, although other types of springs are possible. In some embodiments, the spring 150 comprises a plurality of springs. In some embodiments, the spring 150 can be positioned between the shuttle 500 and the stop component 800. The spring 150 can be configured to encourage the shuttle 500 in the direction of the stop component 800 and/or the sleeve 700. For example, the spring 150 can provide a compressive force that pushes, or a tensile force that pulls, the shuttle 500 towards the stop component 800 and/or the sleeve 700.

Figure 2:
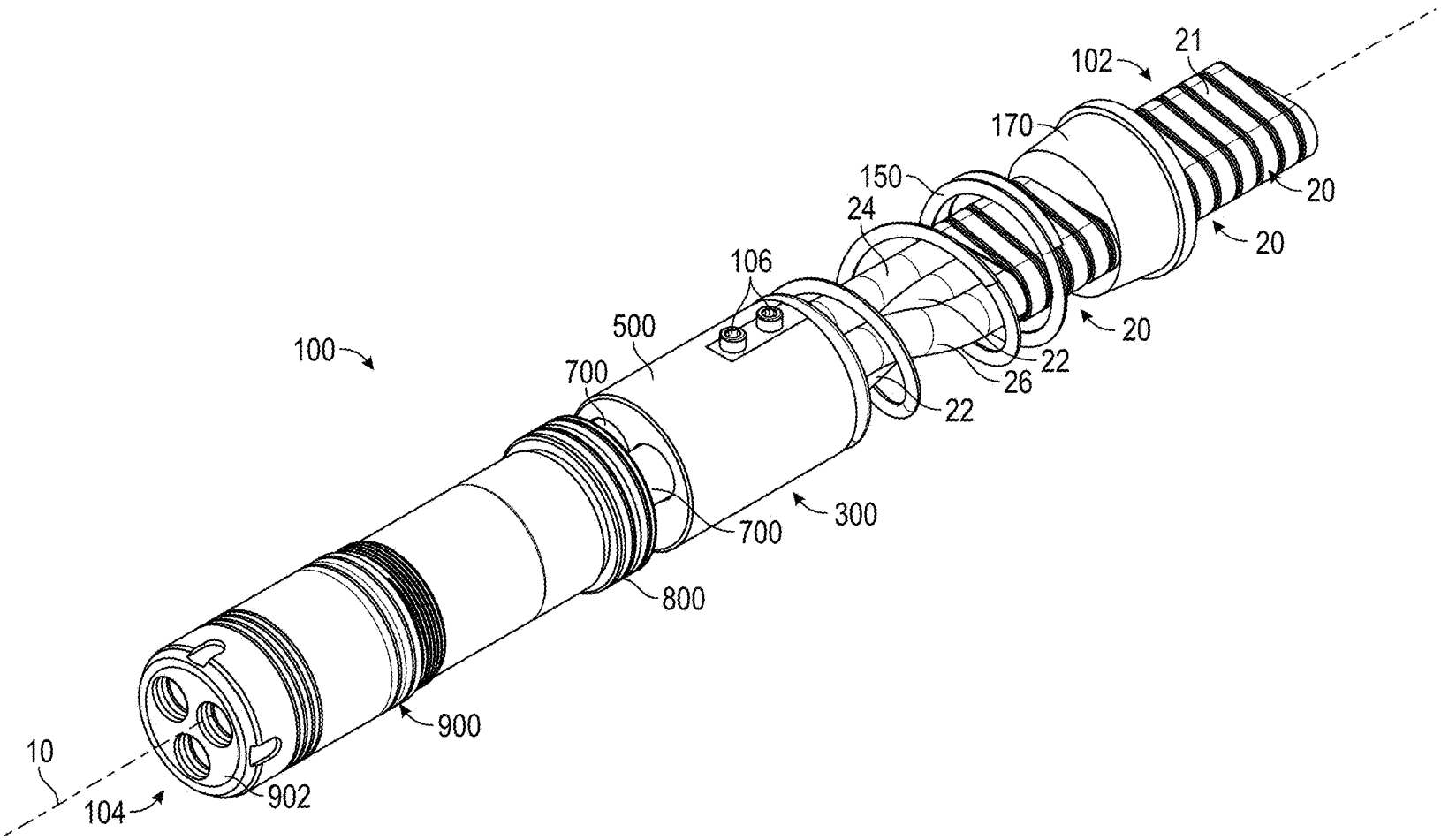
FIG. 2 is an isometric view of an embodiment of certain internal components of the connector of FIG. 1A illustrated with a housing removed.

As shown in FIG. 2, in which the housing 400 has been removed for purposes of presentation, the first, second and third cables 22, 24, 26 of the cable bundle 20 and the sheath 21 extend through the ferrule 170 at the first end 102 of the connector 100. As shown, the first, second and third cables 22, 24, 26 can be aligned closely together in a single plane within the cable bundle 20 as they pass through the first end 102 of the connector 100. A portion of the cable bundle 20 and/or the first, second and third cables 22, 24, 26 can extend through the interior of the spring 150, such that the spring 150 encircles the first, second and third cables 22, 24, 26. The sheath 21 may extend only partway into the interior of the housing 400. Upon exiting the sheath 21, first, second and third cables 22, 24, 26 can be redirected into a generally triangular arrangement for passage through the shuttle 500, and stop component 800. Each of the first, second and third cables 22, 24, 26 can pass through a corresponding sleeve 700 between the shuttle 500 and the stop component 800. In some embodiments, the sleeves 700 extend between the shuttle 500 and the stop component 800 and are at least partially received within the shuttle 500 and the stop component 800. Although not visible in FIG. 2, the first, second and third cables 22, 24, 26 each extend through a sealing boot 600 that is positioned within the shuttle 500. The sealing boots 600 can be configured to buckle or collapse around the first, second and third cables 22, 24, 26 to create a seal around first, second and third cables 22, 24, 26.

Figure 3:
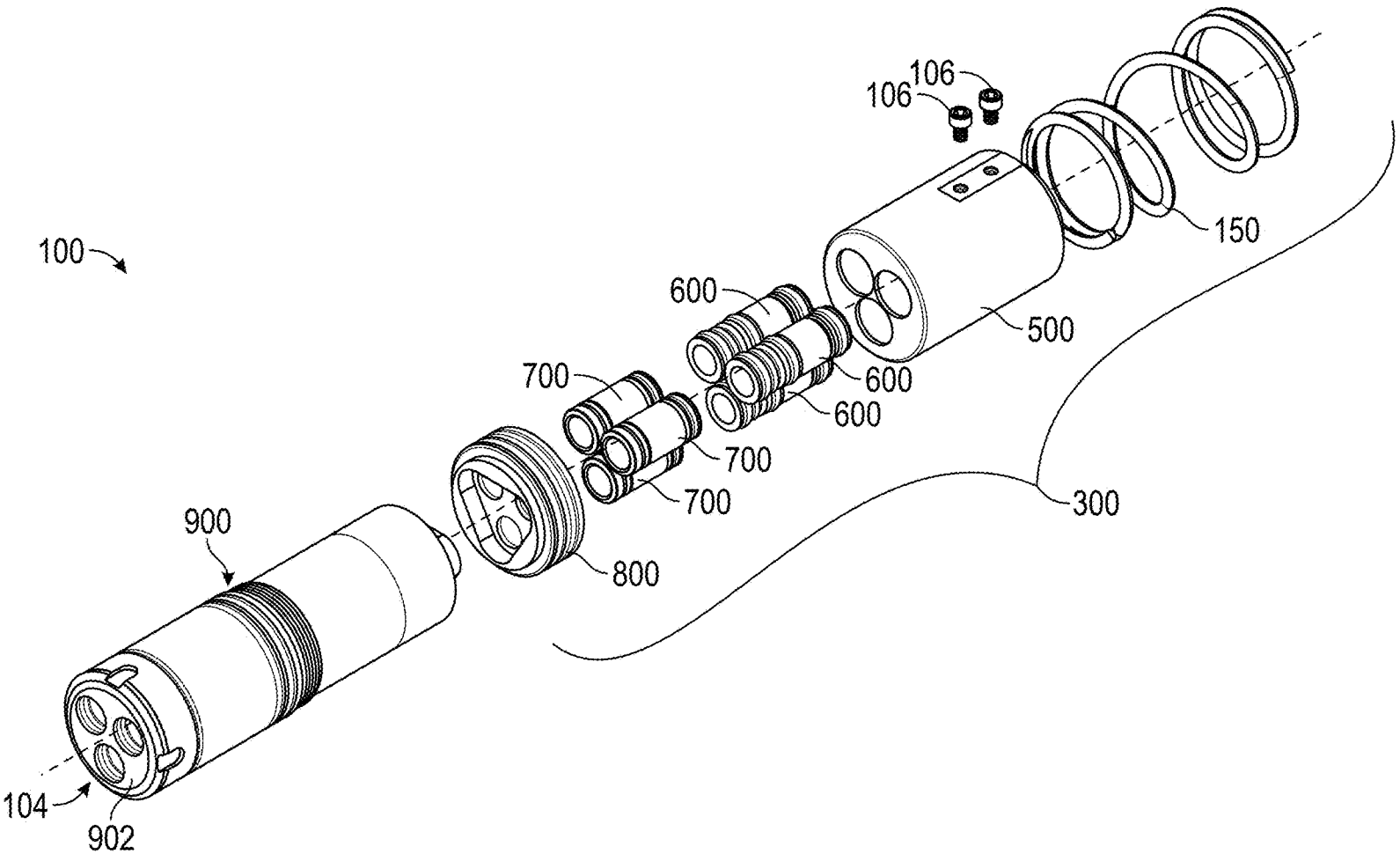
FIG. 3 is an exploded isometric view of some of the internal components of FIG. 2.

FIG. 3 is an exploded isometric view of some of the internal components of the connector 100. The cable bundle 20, the cables 22, 24, 26, and the ferrule 170 are not shown in FIG. 3 for purposes of presentation. As illustrated, the sealing assembly 300 includes the shuttle 500, a plurality of sealing boots 600 (three sealing boots 600 are illustrated in FIG. 3, although other numbers are possible), a plurality of sleeves 700 (three sleeves 700 are illustrated in FIG. 3, although other numbers are possible), and a stop component 800. An embodiment of the shuttle 500 will be described in greater detail with reference to FIGS. 5A-5C. An embodiment of a sealing boot 600 will be described in greater detail with reference to FIGS. 6A and 6B. An embodiment of a sleeve 700 will be described in greater detail with reference to FIGS. 7A and 7B. An embodiment of the stop 800 will be described in greater detail with reference to FIGS. 8A-8D.

As noted previously, in some embodiments, the connector 100 is exposed to a range of temperatures and/or pressures. The sealing assembly 300 can be configured to provide a seal around the cables 22, 24, 26 over a wide range of temperatures and/or pressures. In some embodiments, the position of the shuttle 500 moves to compensate for changes in temperature and/or pressure (compare, for example, the position of the shuttle 500 in FIGS. 10A and 10B, described below). In some embodiment, as the position of the shuttle 500 moves, the sealing boots 600, positioned within the shuttle 500, are compressed between the shuttle 500 and the sleeves 700. As the sealing boots 600 are compressed, the sealing boots 600 can buckle or collapse around the cables 22, 24, 26 forming a seal around the cables 22, 24, 26. In various embodiments, the sleeves 700 have ends that are received in the shuttles 500 and that engage (e.g., contact) the sealing boots 600. As discussed in more detail below, this can inhibit or prevent the sealing boots 600 from being extruded out of position when exposed to a large pressure differential.

In some embodiments, movement of the shuttle 500 may be caused by thermal expansion and/or contraction of one or more of the components of the connector 500. For example, a change in temperature may cause the shuttle 500, the sealing boots 600, and the sleeves 700 to expand or contract. Because these components may be made from different materials with different thermal expansion coefficients, the expansion or contraction may occur to different degrees or different rates for each of these components. As one example, the sealing boots 600 may expand more than the shuttle 500. As the sealing boots 600 expand faster than the bores of the shuttle 500 in which they are positioned, the sealing boots 600 may buckle or collapse to different degrees to automatically adjust. As the sealing boots 600 buckle or collapse to different degrees, the shuttle 500 may move longitudinally to accommodate the sealing boots 600.

As another example, the shuttle 500 and the sleeves 700 may expand more than the sealing boots 600. This may cause the inner diameter of the bores within which the sealing boots 600 are positioned to become larger than an outer diameter of the sealing boots 600. The spring 150 can exert a force on the shuttle 500 that biases the shuttle 500 toward the stop component 800. The force of the spring 150 can compress the sealing boots 600 longitudinally between the shuttle 500 and the sleeves 700. As the sealing boots 600 are compressed, they may automatically buckle or collapse to different degrees so as to automatically fill the larger inner diameter of the bores of shuttle 500 caused by the thermal expansion of the components of the connector 100.

In various embodiments, the shuttle 500 can move (e.g., slide) within the housing 400. In some embodiments, movement of the shuttle 500 may be caused by a pressure differential. For example, in some embodiments, the connector 100 can be positioned such that a first pressure acts on a first end of the shuttle 500 (for example, the right end of the shuttle 500 in FIG. 1B) and a second pressure acts on a second end of the shuttle 500 (for example, the right end of the shuttle 500 in FIG. 1B). In some embodiments, the first pressure may be well pressure and the second pressure may be ambient pressure. If the first pressure is greater than the second pressure, the pressure differential may push the shuttle 500 toward the stop component 800. If the first pressure is less than the second pressure, the pressure differential may push the shuttle 500 away from the stop component 800. In some embodiments, movement of the shuttle 500 is caused by something other than a pressure differential. For example, in certain embodiments, the bias of the spring 150 moves the shuttle 500. In some embodiments, the connector 100 is configured such that substantially equal pressures act on the first and second ends of the shuttle 500. This can enable the shuttle 500 to be substantially pressure balanced between the first and second ends. In certain implementations, the pressure balance of the shuttle 500 enables the spring 150 to move the shuttle 500 even at high pressures (e.g., relative to atmospheric). In some variants, the movement of the shuttle 500 is partly or wholly due to the bias of the spring 150, and/or is not due to a pressure differential on the first and second ends of the shuttle 500. In certain embodiments, the connector 100 is configured to allow fluid to flow between the outside of the shuttle 500 and the inside of the housing 400. In various embodiments, as the shuttle 500 moves (either towards or away from the stop component 800), the sealing boots 600 can buckle or collapse to different degrees or positions to form a seal around the cables 22, 24, 26.

Figure 4A:
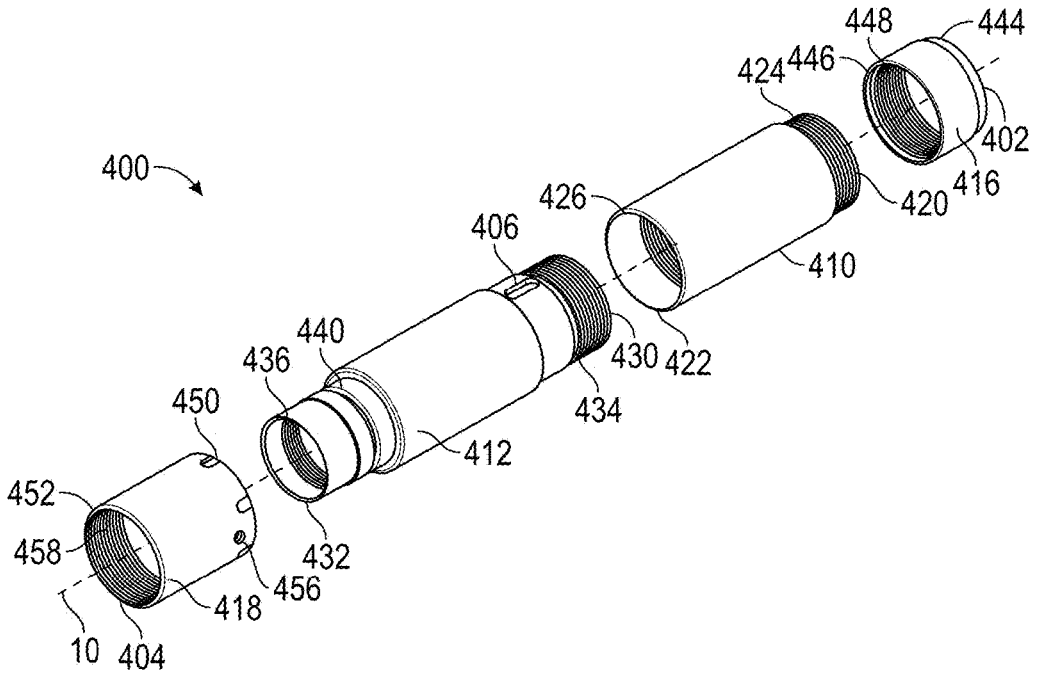
FIG. 4A is an isometric exploded view of components of an embodiment of the housing of the connector of FIG. 1A.
Figure 4B:
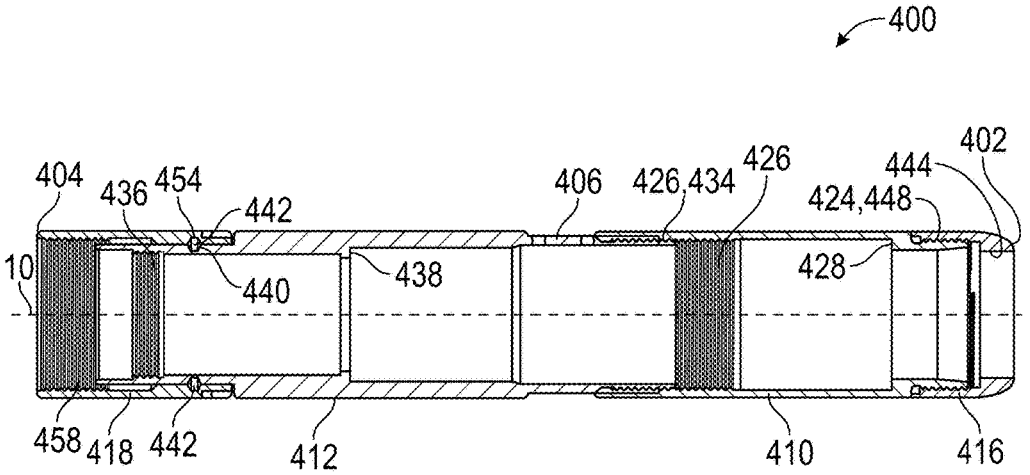
FIG. 4B is a longitudinal cross-sectional view of the housing of the connector of FIG. 1A in an assembled state.

Housing (FIGS. 4A and 4B)

FIG. 4A is an isometric exploded view of an embodiment of the housing 400 of the connector of 100. FIG. 4B is a longitudinal cross-sectional view of the housing 400 in an assembled state. In the illustrated embodiment, the housing 400 comprises a first body member 410, a second body member 412, an end cap 416, and a rotating fastener sleeve 418.

The first body member 410 can be a generally cylindrical tube extending between a first open end 420 and a second open end 422. Proximal to the first open end 420, the first body member 410 can include a first threaded portion 424. The first threaded portion 424 can be configured to attach the end cap 416 to the first open end 420 of the first body member 410. In some embodiments, the first threaded portion 424 comprises external threads on the exterior surface of the first body member 410 as illustrated. In some embodiments, the first threaded portion 424 comprises internal threads on the interior surface of the first body member 410. Proximal to the second open end 422, the first body member 410 can include a second threaded portion 426. The second threaded portion 426 can be configured to attach the first body member 410 to the second body member 412. In some embodiments, the second threaded portion 426 comprises internal threads on the interior surface of the first body member 410 as illustrated. In some embodiments, the second threaded portion 426 comprises external threads on the exterior surface of the first body member 410.

The first body member 410 can also comprise a lip, ledge, protrusion, rib or shoulder 428 formed on the interior surface of the first body member 410. In some embodiments, the shoulder 428 can provide a surface that is normal to the axis 10 which can receive an end of the spring 150. The spring 150 can be compressed against the shoulder 428 such the spring 150 exerts a force that biases the shuttle 150 towards the stop component 800.

The second body member 412 can be a generally cylindrical tube extending between a first open end 430 and a second open end 432. Proximal to the first open end 430, the second body member 412 can include a first threaded portion 434. The first threaded portion 434 can be configured to attach the second body member 412 to the first body member 410. The first threaded portion 434 of the second body member 412 can engage with the second threaded portion 426 of the first body member 410. In some embodiments, the first threaded portion 434 comprises external threads on the exterior surface of the second body member 412 as illustrated. In some embodiments, the first threaded portion 434 comprises internal threads on the interior surface of the second body member 412. Proximal to the second open end 432, the second body member 412 can include a second threaded portion 436. The second threaded portion 426 can be configured to attach the second body member 412 to the receptacle assembly 900. In some embodiments, the second threaded portion 436 comprises internal threads on the interior surface of the second body member 412 as illustrated.

The second body member 412 can also comprise a lip, ledge, protrusion, rib or shoulder 438 formed on the interior surface of the second body member 412. In some embodiments, the shoulder 438 can provide a surface that is normal to the axis 10 which can receive an end of the stop component 800. The shoulder 438 can contact or otherwise interact with the stop component 800 to prevent longitudinal movement of the stop component 800 past the shoulder 438 towards the second end 104 of the connector 100.

The second body member 412 can also include a groove 440. The groove 440 can be an annular groove formed in the exterior surface of the second body member 412. The groove 440 is configured to receive a retaining device 442, such as ball bearings, that retain the rotating fastener sleeve 418 on to the second body member 412 and permit the rotating fastener sleeve 418 to rotate relative to the second body member 412.

As illustrated, the rotating fastener sleeve 418 includes a first open end 450 configured to be received over the second end of the second body member 412. The rotating fastener sleeve 418 also includes a second open end 452. When assembled, a portion of the receptacle assembly can extend through the second open end 452. The rotating fastener sleeve 418 can include a threaded portion 458. In some embodiments, the threaded portion 458 can be used to lock the connector 100 in place once the connector 100 is connected to a corresponding connector, system or device. In some embodiments, the threaded portion 458 comprises internal threads on the interior surface of the rotating fastener sleeve 418 as illustrated. In some embodiments, the threaded portion 458 comprises external threads on the exterior surface of the rotating fastener sleeve 418.

The rotating fastener sleeve 418 can include a groove 454. The groove 454 can be an annular groove formed in the interior surface of the rotating fastener portion 418. The groove 454 is configured to receive the retaining device 442 that retain the rotating fastener sleeve 418 on to the second body member 412 and permit the rotating fastener sleeve 418 to rotate relative to the second body member 412. The rotating fastener sleeve 418 can include a hole 456. In some embodiments, the hole 456 is used for loading the ball bearings into the space created between the grooves 440, 454 of the second body member 412 and the rotating fastener sleeve 418, respectively. In some embodiments, once the retaining device 442 is loaded, the loading hole 456 can be sealed with a disc. In some embodiments, one, two, three, four, five, six, or more retaining devices 442 are loaded in the grooves 440, 454.

The retaining device 442 can retain the rotating fastener sleeve 418 onto the second body member 412 and allow the rotating fastener sleeve 418 to be rotated relative to the second body member 412. This can allow the threaded portion 458 of the rotating fastener sleeve 418 to be engaged with a corresponding structure on a corresponding connector or other device to which the connector 100 is connected. In some embodiments, the rotating connector sleeve 418 can be rotated to tighten the connector 100 to the corresponding connector or other device to which the connector 100 is connected. In some embodiments, the rotating connector sleeve 418 protects the connection between the connector 100 and the corresponding connector or other device to which the connector 100 is connected.

Returning to the first end 402 of the housing 400, the housing 400 includes the end cap 416. An opening 444 is formed through the first end of the end cap 416. The opening 444 is configured to at least partially receive the ferrule 170 therein. The opening 444 also allows passage of the conduits into the interior of the housing 400. The second end of the end cap 446 also includes an opening 446. The end cap 416 also includes a threaded portion 448. The threaded portion 448 is configured to engage the threaded portion 424 of the first body portion 410 to attach the end cap 416 to the first body portion. In some embodiments, the threaded portion 448 is an internally threaded portion formed on the interior surface of the end cap 416.

Although a particular embodiment of the housing 400 is illustrated in FIGS. 4A and 4B, the housing 400 can be varied from the illustrated embodiment in a number of ways. For example, the housing 400 can comprise other number of body members, such as, one, two, three, four, five or more body members. Further, the body members can be connected via other mechanisms or structures than the illustrated threaded portions. For example, in some embodiments, body members are welded, press fit, or adhesively bonded together. Additionally, while the housing 400 has been illustrated as generally cylindrical, other shapes for the housing 400 are possible. In some embodiments, one or more of the components of the housing 400 illustrated in FIGS. 4A and 4B can be omitted. For example, the rotating fastener sleeve 400 may be omitted. In some embodiments, one or more of the components of the housing 400 illustrated in FIGS. 4A and 4B can be combined. For example the first body member 410 and the end cap 416 can be combined. In some embodiments, the housing 400 comprises metals, allows, or other similar or suitable materials.

Figure 5A:
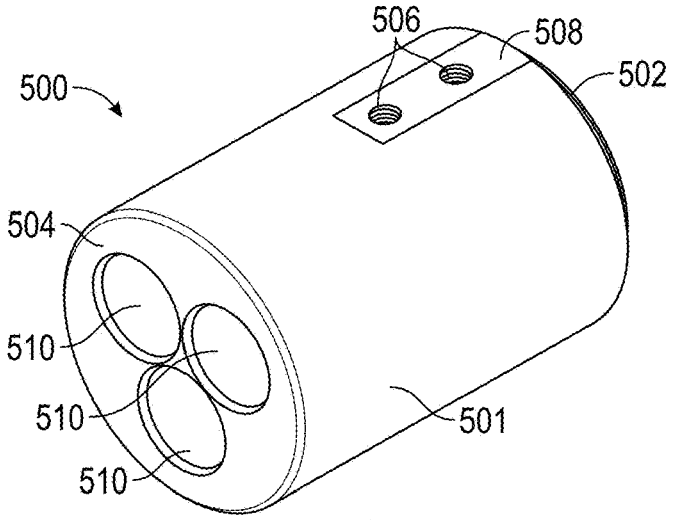
FIGS. 5A and 5B are first and second isometric views of an embodiment of a shuttle of the connector of FIG. 1A.
Figure 5B:
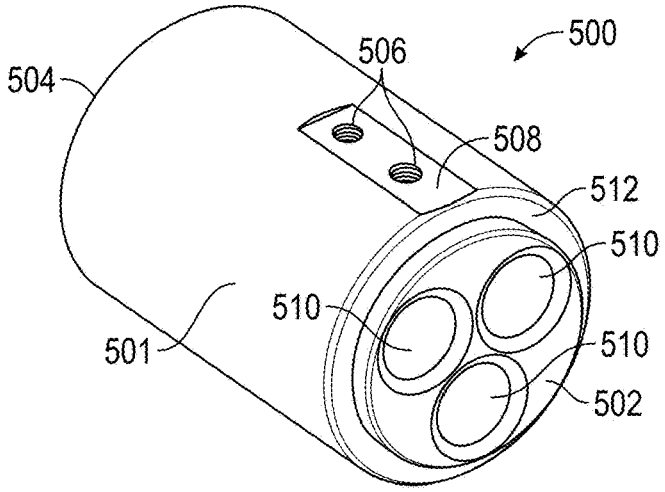
Figure 5C:
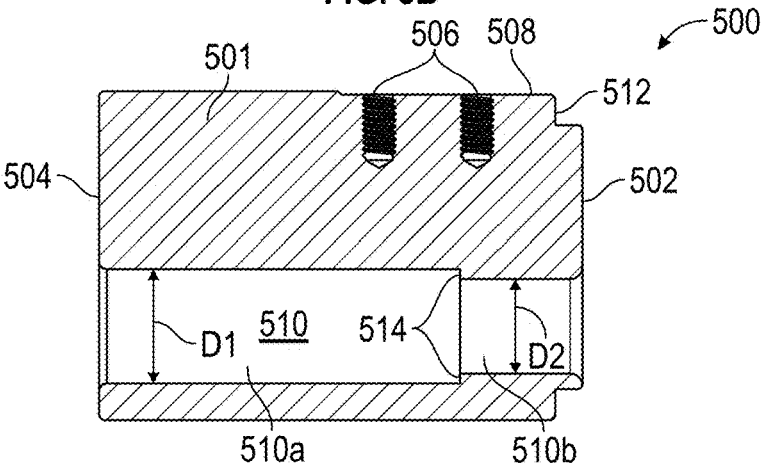
FIG. 5C is a longitudinal cross-sectional view of the shuttle of FIGS. 5A and 5B.

Shuttle (FIGS. 5A-5C)

FIGS. 5A and 5B are first and second isometric views of an embodiment of the shuttle 500 of the connector 100. FIG. 5C is a longitudinal cross-sectional view of the shuttle 500. In the illustrated embodiment, the shuttle 500 includes a body 501 extending between a first end 502 and a second end 504. In the illustrated embodiment, the body 501 is substantially cylindrical, although other shapes are possible. In general, the body 501 is configured in size and shape to fit within the housing 400. The shuttle 500 can be configured to move back and forth longitudinally along the axis 10 within the housing 400. The shape of the body 501 can be configured to match a corresponding interior shape of the housing 400. The first end 502 of the body 501 can be generally flat or planar, although other shapes are possible. The first end of the body 501 can include a groove 512, as shown in FIGS. 5B and 5C. The groove 512 can be an annular groove that surrounds the first end 502. The groove 512 can be configured to receive a second end of the spring 150. The spring 150 can exert a spring force on the body 501 that biases the shuttle 500 towards the stop component 800. The second end 504 of the body 501 can be generally flat or planar, although other shapes are possible.

The shuttle 500 can include one or more openings 506 extending radially into the body 501. In the illustrated embodiment, the shuttle 500 includes two openings 506. The openings 506 are configured to receive the one or more set screws 106. As discussed previously, the set screws 106 can prevent or limit the motion of the shuttle 500 within the housing 400. In some embodiments, the body 501 of the shuttle 500 includes a generally flat surface 508 in the region surrounding the openings 506.

The shuttle 500 can include one or more (e.g., one, two, three, four, or more) bores 510 extending through the body 501. The bores 510 can extend from the first end 502 to the second end 504. In some embodiments, the bores 510 are generally parallel. In some embodiments, the bores 510 extend along axes that are generally parallel to the axis 10. The bores 510 can be configured to allow the first, second, and third cables 22, 24, 26 to pass through the shuttle 500. The number of bores 510 can correspond to the number of cables 22, 24, 26 with which the connector 100 is used. In the illustrated embodiment, the bores 510 are arranged in a triangular arrangement, although other arrangements are possible, such as circular, rectangular, or otherwise.

One of the bores 510 is shown in the cross-sectional view of the shuttle 500 of FIG. 5C. As shown, the bore 510 can include a lip, ledge, protrusion, rib or shoulder 514. The shoulder 514 can narrow the bore 510 from a first diameter $D_1$ to a second diameter $D_2$. The shoulder 514 can divide the bore 510 into a first portion 510*a* and a second portion 510*b*. In some embodiments, the sealing boot 600 is positioned within the first portion 510*a* of the bore 510. The first portion 510*a* may have a first diameter $D_1$. In some embodiments, the first diameter $D_1$ is approximately or substantially equal to the outside diameter OD of the sealing boot 600 in an uncompressed state. In some embodiments, the portion 510*a* of the bore 510 has the first diameter $D_1$ and receives the sealing boot 600. In some embodiments, the first diameter $D_1$ is larger than (for example, 1%, 2%, 3%, 4%, 5%, 7.5%, 10%, or more) the outside diameter OD of the sealing boot 600 in an uncompressed state. In some embodiments, the first diameter $D_1$ is smaller than (for example, 1%, 2%, 3%, 4%, 5%, 7.5%, 10%, or more) the outside diameter OD of the sealing boot 600 in an uncompressed state. In some embodiments, when the sealing boot 600 is positioned within the first portion 510*a* of the bore 510, a first end of the sealing boot 600 abuts against the shoulder 514. The second portion 510*b* of the bore 510 may have a second diameter $D_2$. The second portion 510*b* can be configured to receive a portion of one of the cables 22, 24, 26 positioned therein. The second diameter $D_2$ can be approximately equal to the outside diameter of the cables 22, 24, 26. In some embodiments, the first portion 510*a* is longer than the second portion 510*b*. In some embodiments, the first portion 510*a* is shorter than the second portion 510*b*. In some embodiments, the length of the first portion 510*a* is longer than the length of the sealing boot 600 positioned therein, such that the entirety of the sealing boot 600 can be positioned within the bore 510. The shuttle 500 can comprise metal, alloys, or other similar or suitable materials.

Figure 6A:
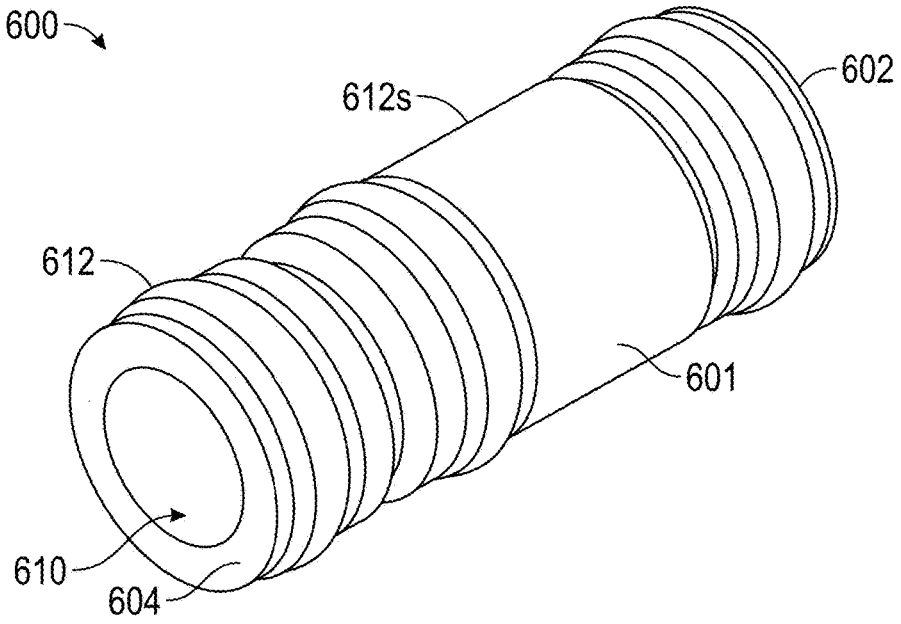
FIG. 6A is an isometric view of an embodiment of a sealing boot of the connector of FIG. 1A.
Figure 6B:
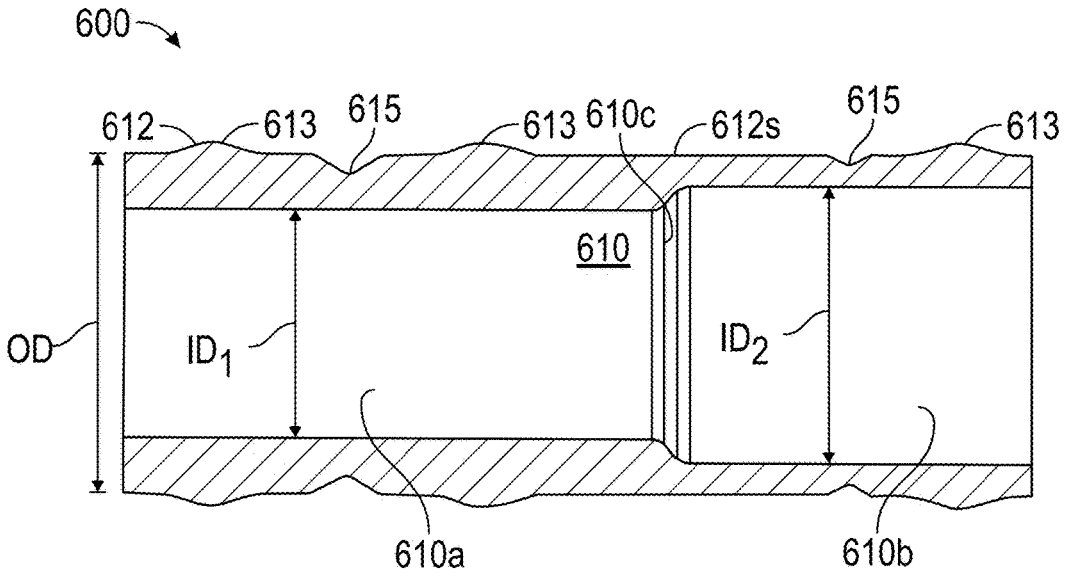
FIG. 6B is a longitudinal cross-sectional view the sealing boot of FIG. 6A.

Sealing Boot (FIGS. 6A and 6B)

FIG. 6A is an isometric view of an embodiment of the sealing boot 600 of the connector 100. FIG. 6B is a longitudinal cross-sectional view of the sealing boot 600. The sealing boot 600 can comprise a generally cylindrical body 601 extending between a first end 602 and a second end 604. A channel 610 extends through the body 601 between the first end 602 and the second end 604. As mentioned above, the sealing boot 600 can be configured to fit within the first portion 510*a* of the bore 510 of the shuttle 500. The channel 610 is configured to receive one of the first, second, and third cables 22, 24, 26. In some embodiments, the first end 602 of the sealing boot 600 engages (e.g., abuts) the shoulder 514 of the channel 510 of the shuttle 500.

As shown in the cross-sectional view of FIG. 6B, in some embodiments, the channel 610 can include a first portion 610*a* having a first inner diameter $ID_1$ and a second portion 610*b* having a second inner diameter $ID_2$. In some embodiments, the first inner diameter $ID_1$ is less than the second inner diameter $ID_2$. In some embodiments, the first inner diameter $ID_1$ is greater than the second inner diameter $ID_2$. In some embodiments, either the first inner diameter $ID_1$ or the second inner diameter $ID_2$ is approximately equal to an outer diameter of the cables 22, 24, 26. In some embodiments, either the first inner diameter $ID_1$ or the second inner diameter $ID_2$ is 1%, 2%, 3%, 4%, 5%, 7.5%, 10%, or more, larger or smaller than the outer diameter of the cables 22, 24, 26. In some embodiments, the second inner diameter $ID_2$ is approximately equal to or 1%, 2%, 3%, 4%, 5%, 7.5%, 10%, or more larger or smaller than the outer diameter of the cables 22, 24, 26 including the outer sheath of the cables 22, 24, 26. In some embodiments, the second inner diameter $ID_2$ is approximately equal to or 1%, 2%, 3%, 4%, 5%, 7.5%, 10%, or more, larger or smaller than the outer diameter of the cables 22, 24, 26 without the outer sheath of the cables 22, 24, 26.

In some embodiments, the first portion 610*a* is longer than the second portion 610*b*. In some embodiments, the second portion 610*b* is longer than the first portion 610*a*. In some embodiments, the first and second portions 610*a*, 610*b* are approximately the same length. In some embodiments, the interior surfaces of the first and second portions 610*a*, 610*b* are substantially smooth. The first and second portions 610*a*, 610*b* can be connected by a transition portion 610*c*.

The sealing boot 600 includes an outer surface 612. The outer surface 612 can have an outside diameter OD as shown. The outside diameter OD of the sealing boot 600 can be configured such that the sealing boot 600 fits within the bore 510 of the shuttle. In some embodiments, the outside diameter OD of the sealing boot 600 is larger or smaller than (for example, 1%, 2%, 3%, 4%, 5%, 7.5%, 10%, or more) the first diameter $D_1$ of the channel 510 of the shuttle 500. As noted previously, the length of the sealing boot 600 can be less than the length of the bore 510 of the shuttle 500 such that the sealing boot 600 fits entirely within the bore 510. In various embodiments, the sealing boot 600 moves longitudinally with the shuttle 500. In certain embodiments, the first end 702 of the sealing boot 600 remains substantially stationary relative to, and/or continuously engaged with, the shoulder 514 of the shuttle 500.

The sealing boot 600 can be configured to buckle or collapse under longitudinal compression. In some embodiments, when the sealing boot 600 is compressed between its first and second ends 602, 604, the sealing boot 600 can buckle or collapse. In some embodiments, when the sealing boot 600 buckles or collapses, one or more of the following may occur: the length of the of the sealing boot 600 can decrease; the outside diameter OD of the body 601 of the sealing boot 600 can increase, and/or the inside diameter ($ID_1$ and/or $ID_2$) of the channel 610 of the sealing boot 600 can decrease. In some embodiments, the inside diameter ($ID_1$ and/or $ID_2$) of the channel 610 of the sealing boot 600 can increase when the boot 600 buckles or collapses. The buckling of the sealing boot 600, and consequent change in shape, can facilitate sealing against the conduit.

The outer surface 612 of the sealing boot 600 can include a profile or shape that facilitates collapsing or buckling. For example, in the illustrated embodiment, the outer surface 612 of the sealing boot 600 includes ridges 613 and valleys 615. In some embodiments, the outer surface 612 may be jagged, wavy, or accordion-like to facilitate collapsing and buckling. In some embodiments, the outer surface 612 of the sealing boot 600 can include one or more smooth sections 612*s*. In the illustrated embodiment, the sealing boot 600 includes an outer surface 612 with a smooth section 612*s* positioned between two sections configured to facilitate buckling. In some embodiments, more than one smooth section 612*s* may be included.

The sealing boot 600 can comprise a rubber, elastomeric, or other similar or suitable material. In some embodiments, the sealing boot 600 comprises a material that facilitates buckling. In some embodiments, the sealing boot 600 comprises a material that expands radially when compressed longitudinally or axially.

Figure 7A:
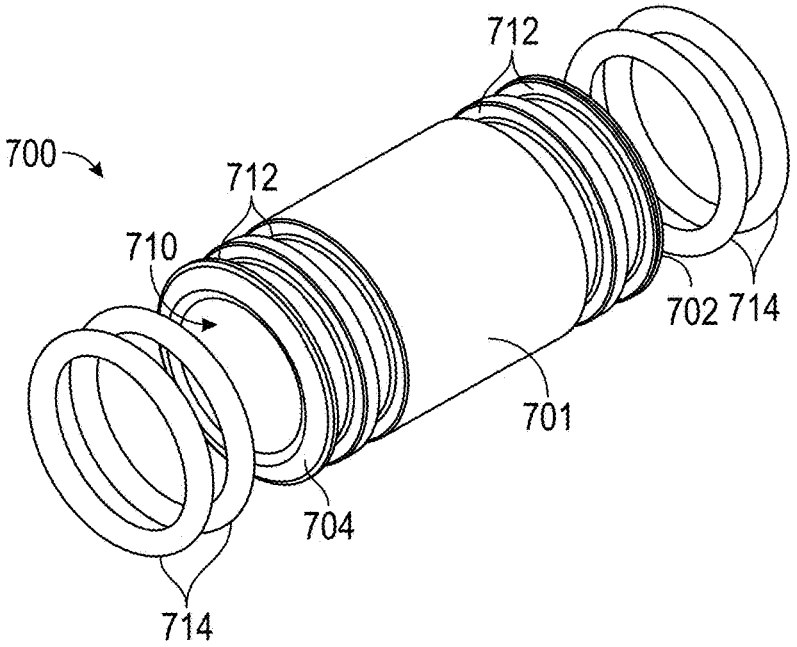
FIG. 7A is an exploded isometric view of an embodiment of a sleeve of the connector of FIG. 1A.
Figure 7B:
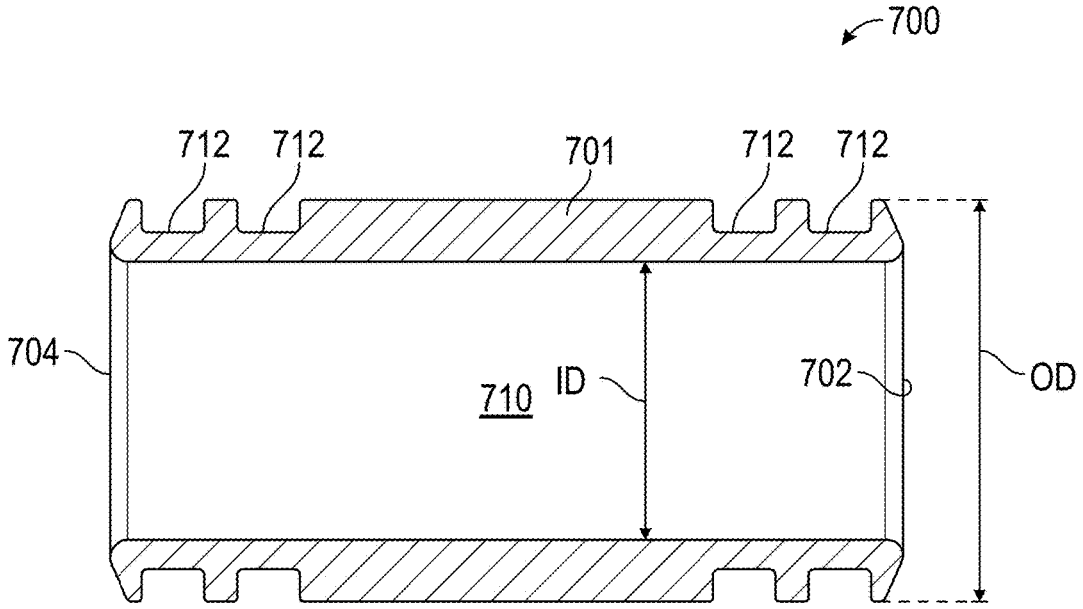
FIG. 7B is a longitudinal cross-sectional view of the sleeve of FIG. 7A.

Sleeve (FIGS. 7A and 7B)

FIG. 7A is an exploded isometric view of an embodiment of a sleeve 700 of the connector 100. FIG. 7B is a longitudinal cross-sectional view of the sleeve 700. The sleeve 700 can comprise a body 701 extending between a first end 702 and a second end 704. The body 701 can be substantially cylindrical, although other shapes are possible. The body 701 can have an outer diameter OD as shown. In various embodiments, the first end 702 is configured to be received in the bore 510 of the shuttle 500. In some embodiments, the outer diameter OD of the body 701 of the sleeve 700 may be approximately equal to the diameter $D_1$ of the bore 510 of the shuttle 500. In some embodiments, the outer diameter OD of the body 701 of the sleeve 700 may be approximately 1%, 2%, 3%, 4%, 5%, 7.5% 10%, 12.5%, 15%, 17.5%, 20%, or more, less than the diameter $D_1$ of the bore 510 of the shuttle 500. In general, the body 701 is configured such that at least a portion of the body 701 can be received within the bore 510 of the shuttle 500 and another portion of the body 701 can contact, be received within, or otherwise engage with the stop component 800 (as shown in FIG. 1B). The sleeve 700 can engage (e.g., abut) the sealing boot 600. For example, in some embodiments, a portion of the sleeve 700 that is received in the bore 510 engages the sealing boot 600.

The body 701 can include grooves 712. The grooves 712 can be configured to receive gaskets, such as O-rings 714. In the illustrated embodiment, the body 701 includes two grooves 712 proximate to the first end 702 for receiving two O-rings 714, and two grooves 712 proximate to the second end 704 for receiving two additional O-rings 714. In some embodiments, when installed, the O-rings 714 proximate the first end 702 are positioned within the bore 510 of the shuttle 500, as shown in FIG. 1B. Similarly, in some embodiments, when installed, the O-rings 714 proximate the second end 704 are positioned within the stop component 800, as shown in FIG. 1B. In some embodiments, other numbers and positions of grooves 712 and O-rings 714 can be included. In some embodiments, the grooves 712 and O-rings 714 are omitted.

The aperture 710 includes an inner diameter ID. The inner diameter ID is configured such that a cable 22, 24, 26 can extend therethrough. In some embodiments, the inner diameter ID is larger or smaller than the outer diameter of the cables 22, 24, 26 by 1%, 2%, 3%, 4%, 5%, 7.5%, 10%, or more. In some embodiments, the inner diameter ID of the aperture 710 can be substantially constant along its length. In some embodiments, when installed, the aperture 710 extends parallel to the axis 10.

The body 701 of the sleeve 700 can comprise metal, alloys, or other similar or suitable materials. The O-rings 714 can comprise rubber, elastomeric, or other similar or suitable materials. In some implementations, the sleeve 700 is integral with or press-fit into the stop component 800.

Figure 8A:
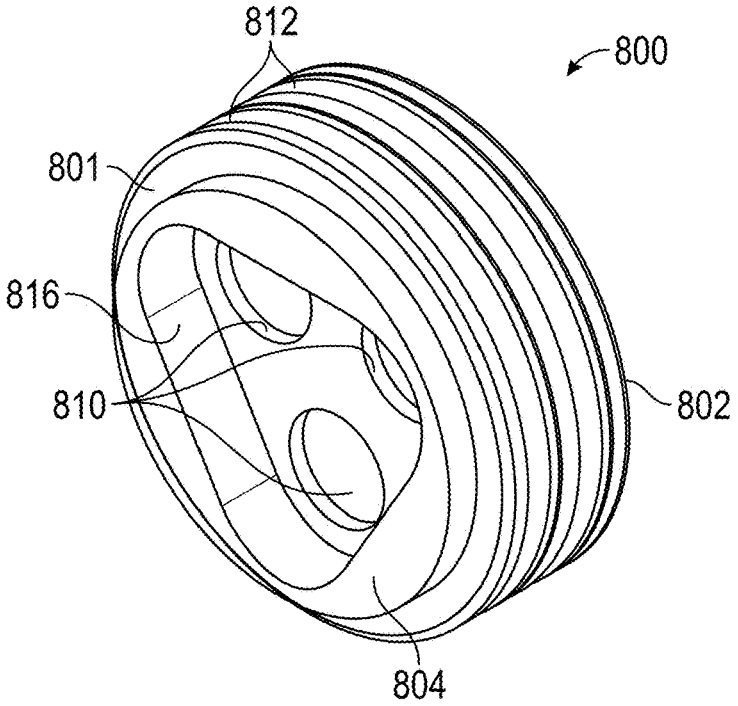
FIGS. 8A and 8B are first and second isometric views of an embodiment of a stop component of the connector of FIG. 1A.
Figure 8B:
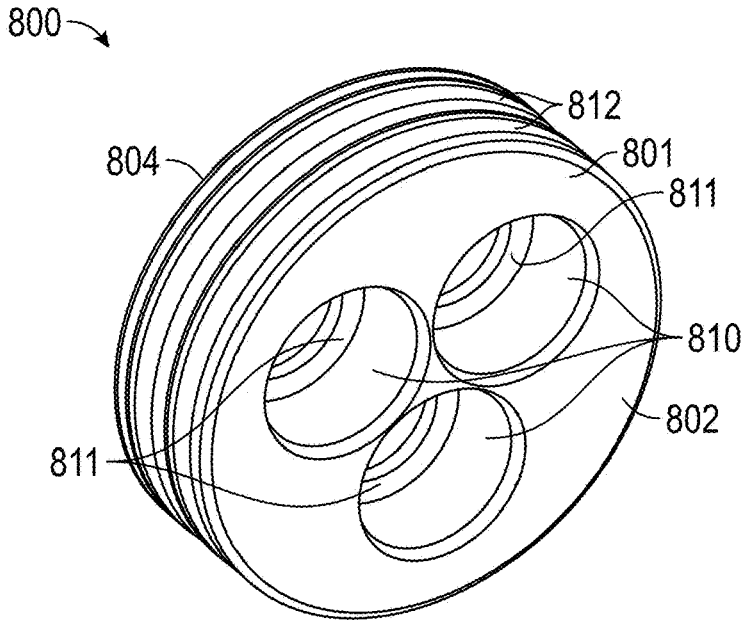

Sleeve (FIGS. 8A and 8B)

Figure 8C:
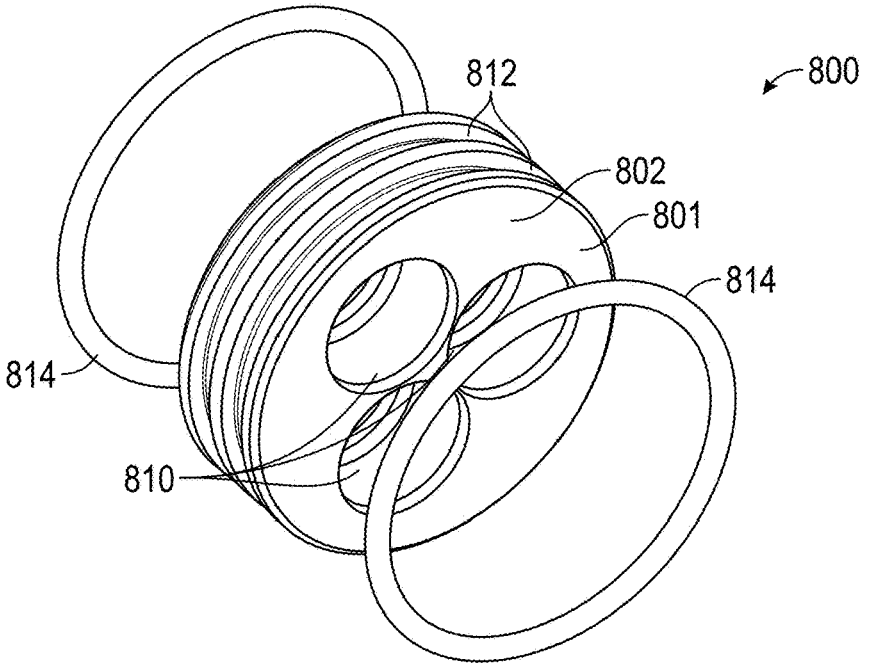
FIG. 8C is an exploded isometric view of the stop component of FIGS. 8A and 8B.
Figure 8D:
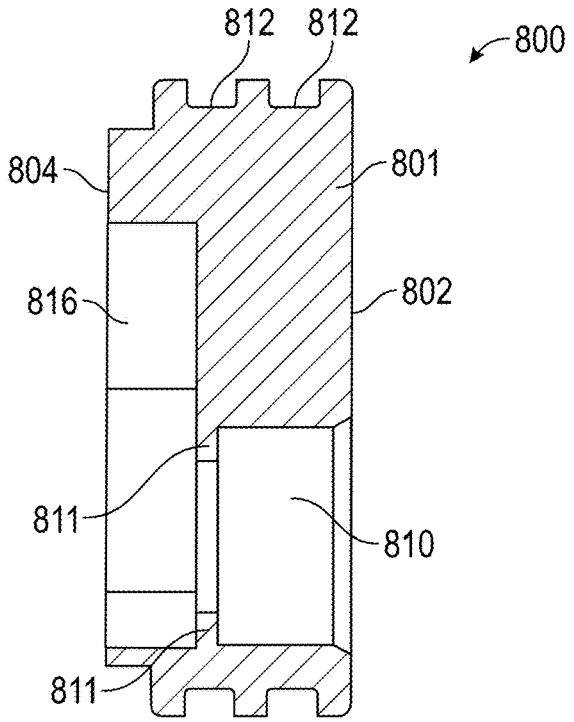
FIG. 8D is a longitudinal cross-sectional view of the stop component of FIGS. 8A and 8B.

FIGS. 8A and 8B are first and second isometric views of an embodiment of a stop component 800 of the connector 100. FIG. 8C is an exploded isometric view of the stop component 800. FIG. 8D is a longitudinal cross-sectional view of the stop component 800.

The stop component 800 can comprise a body 801 extending between a first end 802 and a second end 804. The body 801 can be substantially or generally cylindrical, although other shapes are possible. The body 801 may have an outer diameter configured to fit within the interior of the housing 400. In some embodiments, the body 801 fits tightly within the housing 400 and creates a seal against the housing 400. In some embodiments, the outer diameter of the body 801 of the stop component 800 may be approximately equal to the inside diameter of the housing 400. The body 801 can include grooves 812. The grooves 812 can be configured to receive gaskets or O-rings 814. In the illustrated embodiment, the body 801 includes two grooves 812 for receiving two O-rings 814. Other numbers of grooves 812 and O-rings 814 are possible. The O-rings 814 may help form a seal between the outer diameter of the body 801 and the interior of the housing 400. This can inhibit or prevent fluid from passing between the body 801 and the housing 400.

As shown in FIGS. 8A and 8D, a recess 816 may be formed into the second end 804 of the body 801. The recess 816 may extend partway into the body 801. The recess 816 may be configured to receive or engage a corresponding protrusion 916 on the receptacle assembly 900. In the illustrated embodiment, the recess 816 is generally triangular, although other shapes for the recess 916 are possible. In some embodiments, the recess 816 and the corresponding protrusion 916 comprise corresponding keyed shapes. The keyed shapes may, for example, facilitate alignment between the stop component 800 and the receptacle assembly 900.

As shown in FIGS. 8B-8D, the stop component 800 includes one or more bores extending into the first end 802 of the body 801. In the illustrated embodiment, three openings 810 are shown, although other numbers of openings 810 are possible. The number of openings 810 can correspond with the number of cables 22, 24, 26 with which the connector 100 is used. The openings 810 can extend entirely through the body 801 of the stop component 800, such that the conduits can pass therethrough. The openings 810 can be configured in size and shape to receive at least a portion of the sleeves 700 therein. The openings 810 can include a protrusion or lip 811. The lip 811 can provide a face against which the second end 704 of the sleeves 700 can abut. The face can be generally normal to the axis 10. The lip 811 can inhibit or prevent or stop the sleeves 700 from being pushed longitudinally towards the second end 104 of the connector.

The body 801 of the stop component 800 can comprise metal, alloys, or other similar or suitable materials. The O-rings 814 can comprise rubber, elastomeric, or other similar or suitable materials.

Figure 9A:
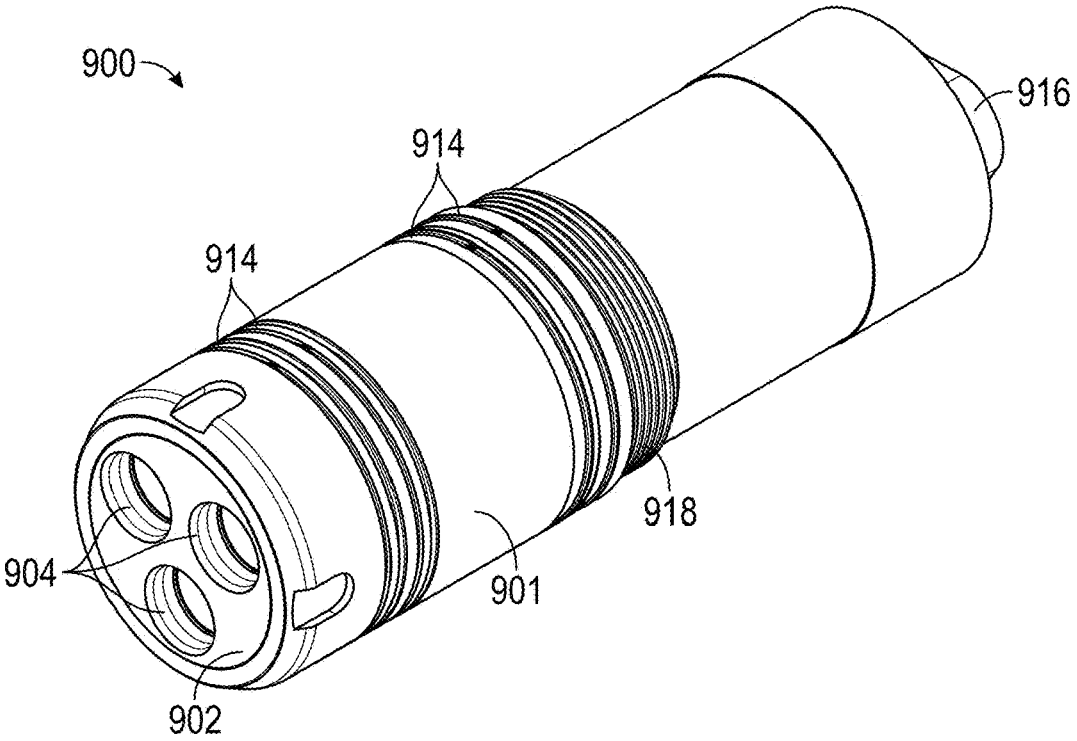
FIGS. 9A and 9B are first and second isometric views of an embodiment of a receptacle assembly of the connector of FIG. 1A.
Figure 9B:
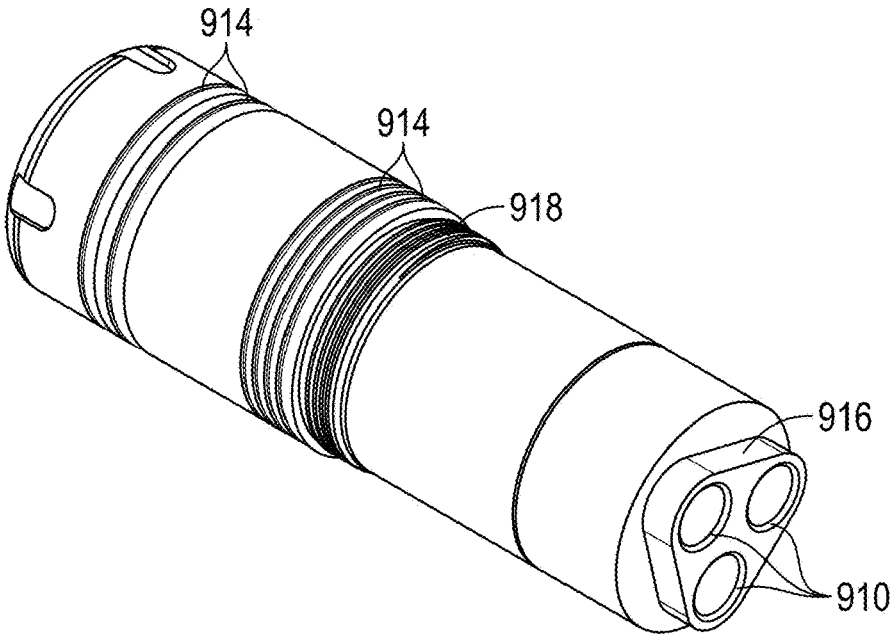

Receptacle Assembly (FIGS. 9A and 9B)

FIGS. 9A and 9B are first and second isometric views of an embodiment of a receptacle assembly 900 of the connector 100. The receptacle assembly 900 includes a body 901. A first end of the body 901 can include the protrusion 916 that is configured to engage with the recess 816 of the stop component 800. Channels 910 can extend through the protrusion 916 to the interior of the body 901. The channels 910 can allow the cables 22, 24, 26 to pass into the interior of the receptacle assembly. A second end of the body 901 can include the socket 902 and holes 904 that are used to connect the connector 100 to a plug of a corresponding connector or other device. As shown, the body 901 can include one or more grooves 914, which can hold one or more O-rings for creating a seal against the interior of the housing 400. The body 901 can include a threaded portion 918 that can be positioned to engage the threaded portion 436 of the second body portion 412 of the housing 400. The receptacle assembly 900 may include one or more gaskets, such as O-rings 922, that provide seals between various components of the receptacle assembly 900.

Figure 9C:
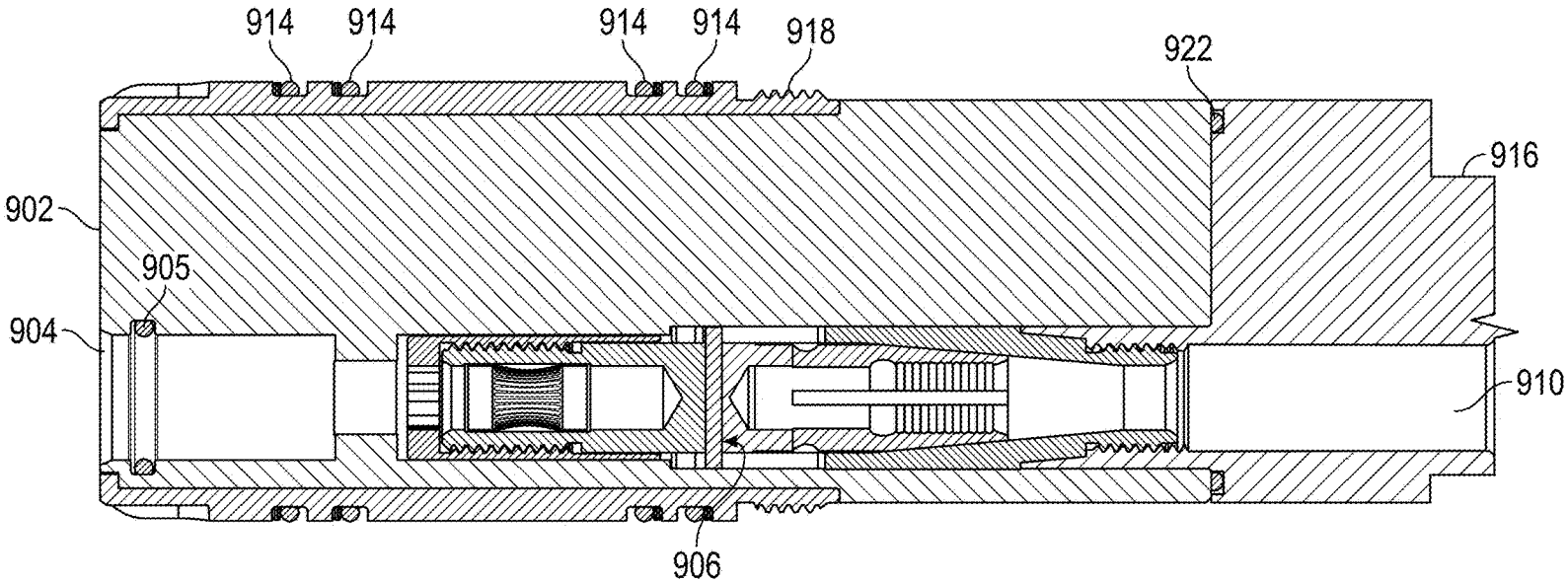
FIG. 9C is a longitudinal cross-sectional view of the receptacle assembly of FIGS. 9A and 9B.

FIG. 9C is a longitudinal cross-sectional view of the receptacle 900. As shown, the channels 910 pass to a connection assembly 906. The connection assembly 906 provides a termination point for the cables 22, 24, 26 and an electrical connection to conductors positioned within the holes 904 of the socket 902. In some embodiments the connection assembly 906 includes a crimpless electrical connector as described in U.S. patent application Ser. No. 15/481,189, entitled "Crimpless Electrical Connector," filed on Apr. 6, 2017, which is incorporated by reference in its entirety. In some embodiments, a connection assembly 906 is positioned within each of the channels 910. The number of connections assemblies 906 can correspond to the number of cables 22, 24, 26.

Figure 10A:
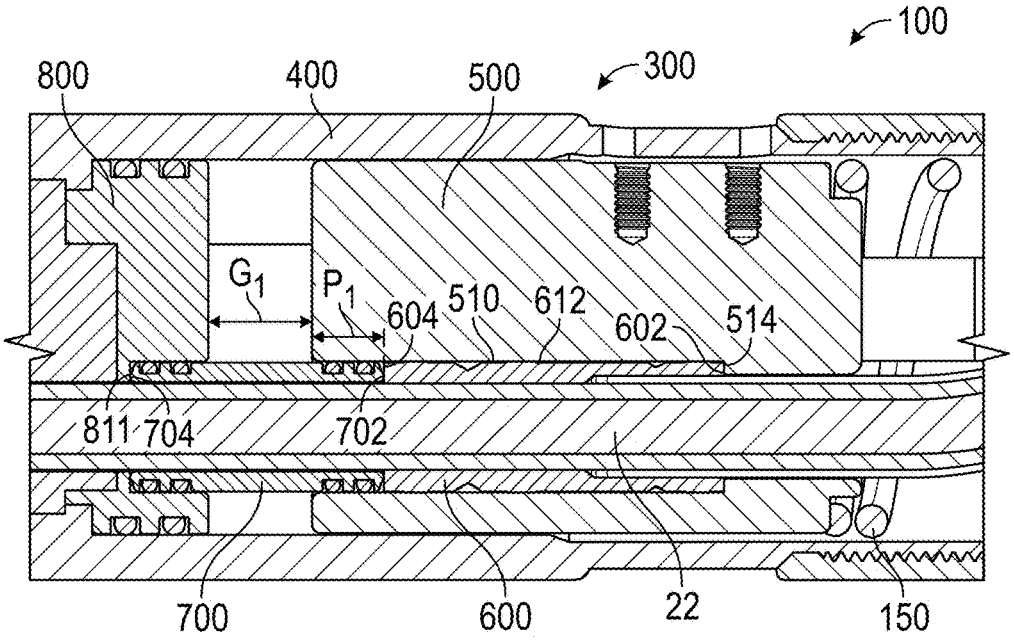
FIG. 10A is a longitudinal cross-sectional detail view of an embodiment of a sealing assembly of the connector of FIG. 1A, illustrated with the shuttle in a first position.
Figure 10B:
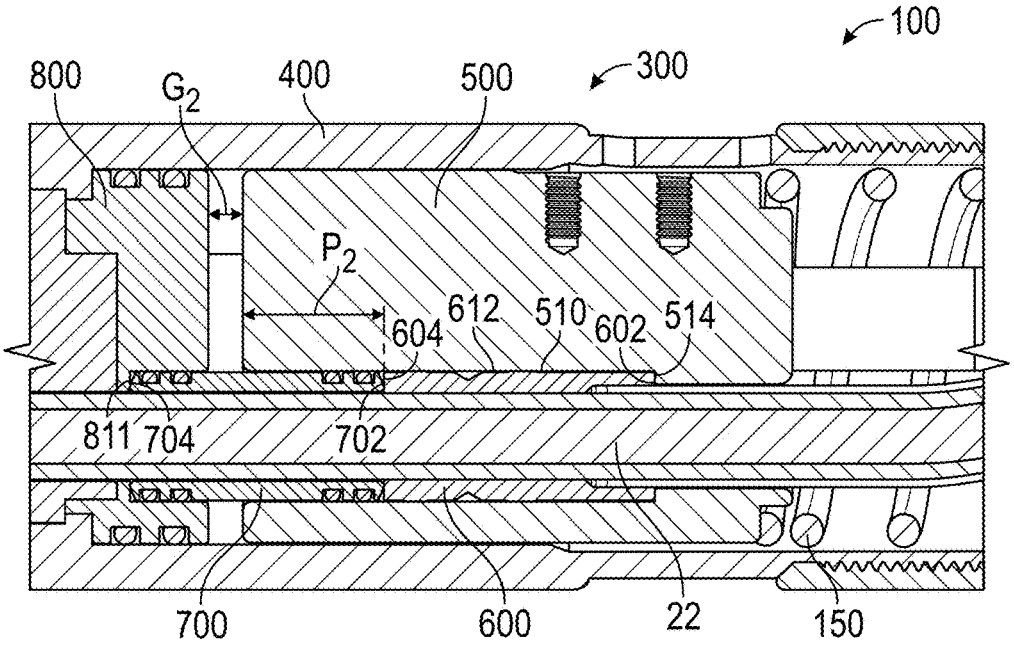
FIG. 10B is a longitudinal cross-sectional detail view of an embodiment of the sealing assembly of the connector of FIG. 1A, illustrated with the shuttle in a second position.

Operation of the Connector (FIGS. 10A and 10B)

FIGS. 10A and 10B illustrate operation of the connector 100 according to an embodiment. As discussed above, movement of the shuttle 500 can be caused by changes in pressures or pressure differentials to which the connector 100 is exposed, and/or by changes in temperature due to thermal expansion or contraction of the components. FIG. 10A is a longitudinal cross-sectional detail view the sealing assembly 300 of the connector of 100 with the shuttle 500 in a first position, and FIG. 10B illustrates the shuttle 500 in a second position. As shown in FIGS. 10A and 10B, the sealing boot 600 can buckle or collapse to different degrees depending upon the position of the shuttle 500 within the housing 400. In some embodiments, this permits the sealing assembly 300 to provide a seal around the cables 22, 24, 26 over a range of temperatures and/or pressures.

As shown in FIGS. 10A and 10B, the sealing boot 600 is positioned in the bore 510 of the shuttle 500. The sealing boot 600 is radially positioned between the cable 22 and the shuttle 500. The sealing boot 600 is longitudinally positioned between the shoulder 514 of the shuttle 500 and the first end 702 of the sleeve 700. A portion of the sleeve 700 extends partially into the bore 510 of the shuttle 500. Substantially the entire or the entirety of the sealing boot 600 can be bounded and/or captured between the cable 22, bore 510, and sleeve 700. This can, inhibit or prevent the sealing boot 600 from being extruded (e.g., due to a pressure differential). As shown, in some implementations, the sleeve 700 includes one or more gaskets, such as O-rings, which can engage with the shuttle 500 and/or the stop component 800. The gaskets in the sleeve 700 can inhibit or prevent fluid from passing around the outside of the sleeve 700.

In various embodiments, the shuttle 500 can be configured to move longitudinally in the housing 400, such as between a first position and a second position. As mentioned above, in some embodiments, the shuttle 500 moves in response to the spring 150 biasing the shuttle 500 and/or a fluid pressure acting on the shuttle 500. In the illustrated first position of FIG. 10A, the shuttle 500 is spaced apart from the stop component 800 by a gap $G_1$. The gap $G_1$ may be approximately at least 1/20, 1/15, 1/10, 1/4, or 1/2 the length of the shuttle 500. The gap $G_1$ may be approximately at least 1/20, 1/15, 1/10, 1/4, 1/2, or 3/4 the length of the sleeve 700. The gap $G_1$ may be approximately at least 1/20, 1/15, 1/10, 1/4, 1/2, or 3/4 the length of the sealing boot 600. A portion of length $P_1$ of the sleeve 700 is positioned within the bore 510 of the shuttle 500. The length $P_1$ may be approximately at least 1/20, 1/15, 1/10, 1/4, or 1/2 the length of the shuttle 500. The length $P_1$ may be approximately at least 1/20, 1/15, 1/10, 1/4, 1/2, or 3/4 the length of the sleeve 700. The length $P_1$ may be approximately at least 1/20, 1/15, 1/10, 1/4, 1/2, or 3/4 the length of the sealing boot 600. The sealing boot 600 may buckle or collapse to a degree such that the length of the sealing boot 600 fills the distance between the first end 702 of the sleeve 700 and the shoulder 514 of the shuttle.

In the illustrated second position of FIG. 10B, the shuttle 500 has moved towards the stop component 800. In the second position, the shuttle 500 is spaced apart from the stop component 800 by a gap $G_2$. The gap $G_2$ may be approximately at least 1/20, 1/15, 1/10, 1/4, or 1/2 the length of the shuttle 500. The gap $G_2$ may be approximately at least 1/20, 1/15, 1/10, 1/4, 1/2, or 3/4 the length of the sleeve 700. The gap $G_2$ may be approximately at least 1/20, 1/15, 1/10, 1/4, 1/2, or 3/4 the length of the sealing boot 600. The gap $G_2$ may be at least 10%, 20%, 30%, 40%, or 50% less than the gap $G_1$ the A portion of length $P_2$ of the sleeve 700 is positioned within the bore 510 of the shuttle 500. The length $P_2$ may be approximately at least 1/20, 1/15, 1/10, 1/4, or 1/2 the length of the shuttle 500. The length $P_2$ may be approximately at least 1/20, 1/15, 1/10, 1/4, 1/2, or 3/4 the length of the sleeve 700. The length $P_2$ may be approximately at least 1/20, 1/15, 1/10, 1/4, 1/2, or 3/4 the length of the sealing boot 600. The portion $P_2$ may be at least 10%, 20%, 30%, 40%, or 50% more than the portion $P_1$. As illustrated in FIG. 10B, the sealing boot 600 has buckled or collapsed to a greater degree than in FIG. 10A, such that the length of the sealing boot 600 fills the now shorter distance between the first end 702 of the sleeve 700 and the shoulder 514 of the shuttle.

In various embodiments, the engagement sleeve 700 inhibits or prevents the sealing boot 600 from being extruded, such as in response to a pressure differential. For example, the engagement sleeve 700 can provide physical stop against which the sealing boot 600 engages and/or is prevented from moving any further toward the second end 104 of the connector 100. In certain situations, such as at high pressures (e.g., about 5000 psi), rubber sealing elements (e.g., boot, o-rings, etc.) may tend to extrude through gaps larger than around 0.005 inches. In certain embodiments, the connector 100 is configured to inhibit or prevent extrusion of the sealing boot 600, such as extrusion between the outside diameter of the sleeve 700 and the inside diameter of the bore 510. In some embodiments, the outside of the shuttle 700 and the inside of the bore 510 are dimensioned and/or toleranced to inhibit extrusion of the sealing boot 600. For example, in some variants, the radial clearance (e.g., gap) between the outside of the shuttle 700 and the inside of the bore 510 is less than or equal to about: 0.001 inches, 0.002 inches, 0.004 inches, or other values.

In several embodiments, the sealing boot 600 expands or collapses (e.g., buckles) in response to movements of the shuttle 500. For example, the sealing boot 600 can collapse in response to the shuttle 500 moving toward the stop 800 and/or can expand in response to the shuttle 500 moving away from the stop 800. The sealing boot 600 can collapse to a degree that is dependent upon the position of the shuttle 500. In some embodiments, the position that the shuttle 500 moves is dependent upon or affected by the degree to which the sealing boot 600 collapses. In some embodiments, the shuttle 500 moves and the sealing boot 600 collapses to different degrees to provide a seal over a range of temperatures and pressures. In some embodiments, the shuttle 500 moves and the sealing boot 600 collapses automatically in response to changes in temperature and pressure.

In various embodiments, in response to the collapsing of the sealing boot 600, the outside and/or inside diameter of the sealing boot 600 changes. For example, the outside diameter can increase and/or the inside diameter can decrease. The change in outside and/or inside diameter can facilitate sealing the sealing boot 600 against the bore 510 and/or the cable 22. This sealing between the boot 600 and the bore 510 and/or the cable 22 can inhibit or prevent pressure from the first end 102 of the connector (e.g., at well pressure) from being transferred to the second end 104 of the connector 100 (e.g., at approximately atmospheric pressure).

Figure 11A:
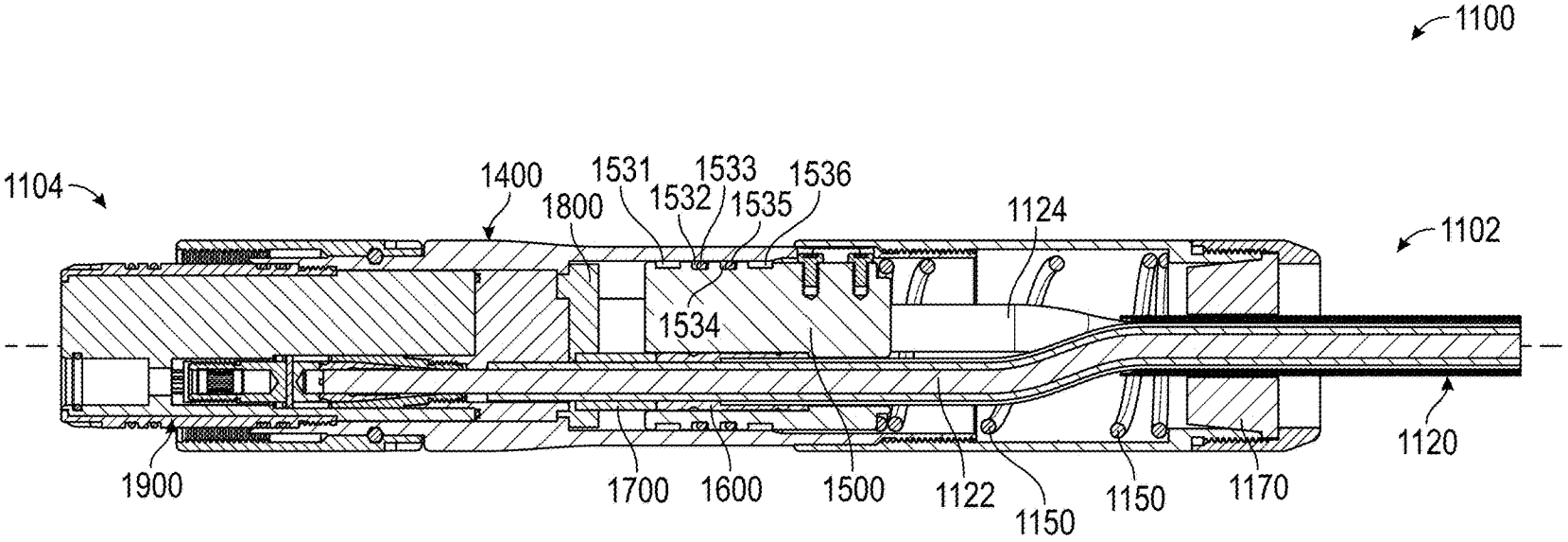
FIG. 11A is a longitudinal cross-sectional view of another embodiment of a connector.
Figure 11B:
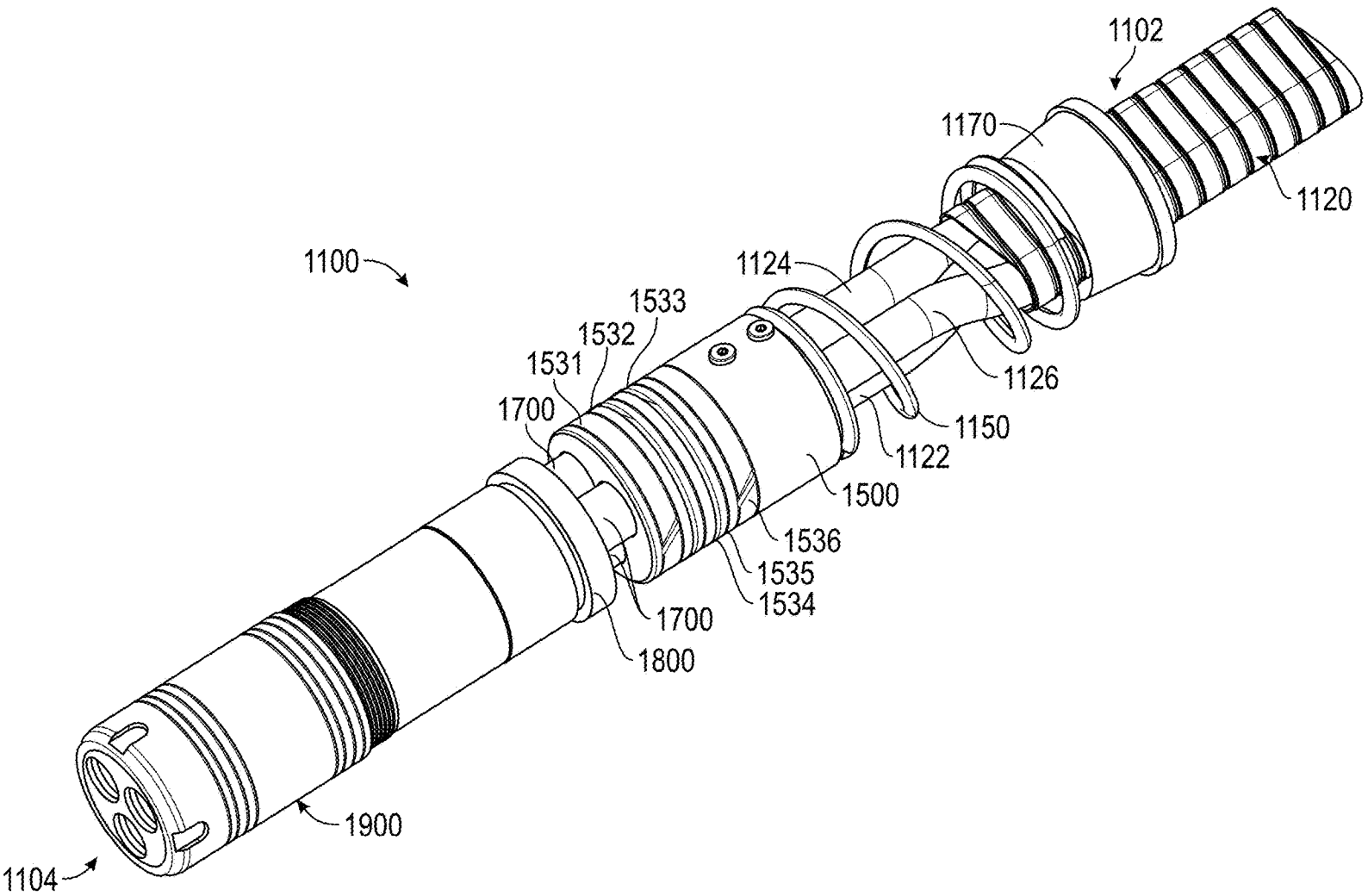
FIG. 11B is an isometric view of an embodiment of certain internal components of the connector of FIG. 11A illustrated with a housing removed.
Figure 11C:
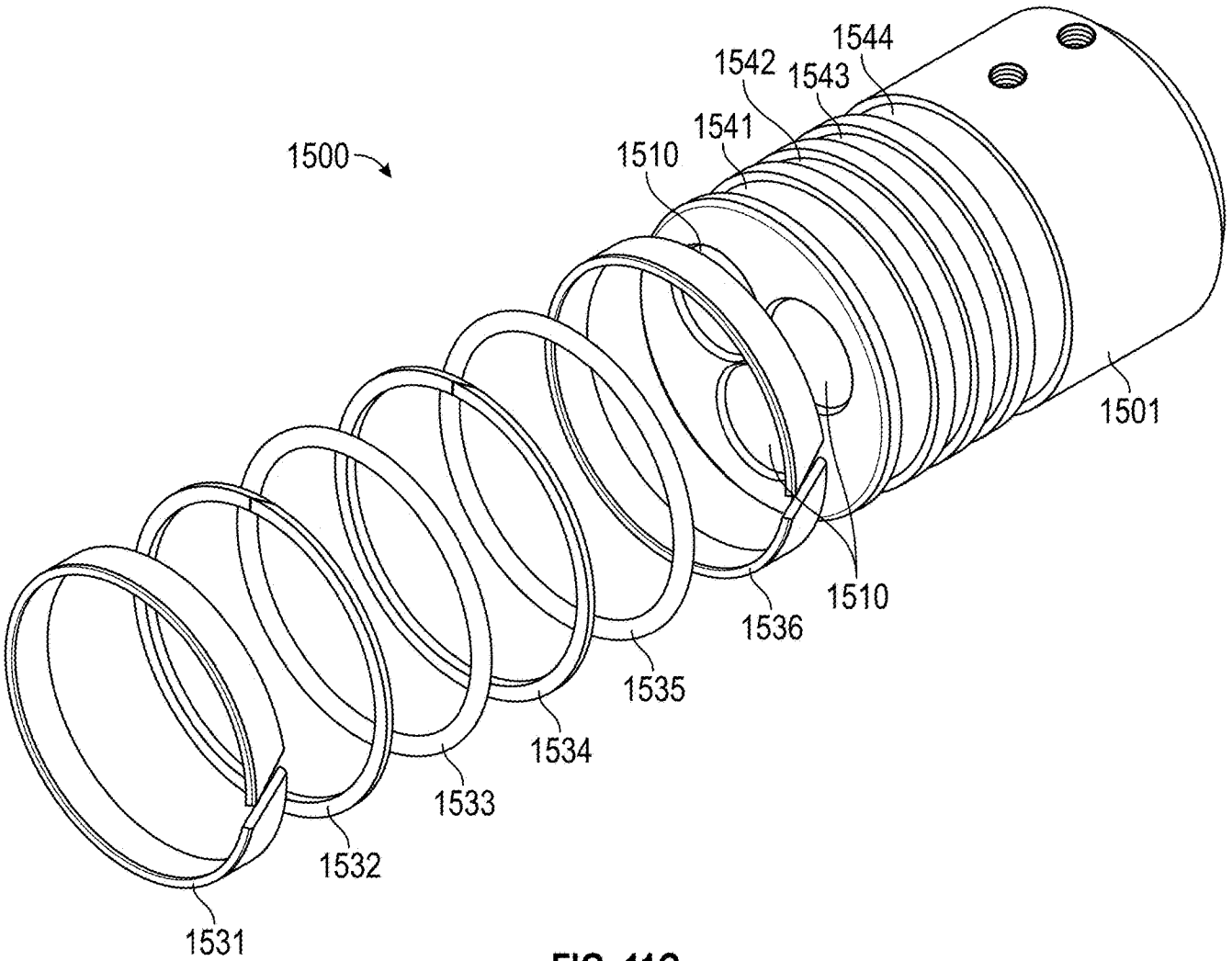
FIG. 11C is an isometric exploded view of an embodiment of a shuttle of the connector of FIG. 11A.

Certain Embodiments (FIGS. 11A-11C)

FIGS. 11A-11C are views of another embodiment of a connector 1100. In many respects, the connector 1100 is similar to the connector 100 described above. Certain similar aspects of the connector 1100 will not be described again here, with the understanding that similar features have been previously described with reference to the connector 100. FIG. 11A is a longitudinal cross-sectional view of the connector 1100. FIG. 11B is an isometric view of certain internal components of the connector 1100. FIG. 11C is an isometric exploded a shuttle 1500 of the connector of 1100.

The connector 1100 extends between a first end 1102 and a second end 1104. A cable bundle 1120 extends into a housing 1400 through the first end 1102. The cable bundle 1120 can include one or more cables (e.g., insulated electrical wires). For example, the illustrated embodiment has three cables 1122, 1124, 1126. As shown, a receptacle assembly 1900 can be positioned at the second end 1104.

A sealing assembly 1300 can be positioned in the housing 1400. The sealing assembly 1300 can include a shuttle 1500, sealing boot 1600, sleeve 1700, and a stop component 1800. Some variants comprise multiple shuttles 1500, sealing boots 1600, sleeves 1700, and/or stop components 1800. A biasing member, such as spring 1150, can bias the shuttle 1500 toward the stop component 1800. The shuttle 1500 can be configured to move relative to the sleeve 1700 and/or the housing 1400. The sealing boot 1600 can be configured to collapse or buckle, such as in the manner described above. In various embodiments, the sealing boot 1600 moves longitudinally with the shuttle 1500.

As shown in FIG. 11A, the sleeve 1700 is a substantially cylindrical tube. In certain implementations, the sleeve 1700 is rigidly connected with the stop component 1800. For example, the sleeve 1700 can be integral with the stop component 1800 or can be press-fit with the stop component 800. In some embodiments, the sleeve 1700 does not include gaskets, such as O-rings.

As shown in FIGS. 11A-11C, the shuttle 1500 can include certain features which can provide a seal against the interior of the housing 1400. For example, as illustrated, the shuttle 1500 can include one or more gaskets (e.g., O-rings) 1533, 1535. The gaskets 1533, 1535 can be retained by one or more retaining units, such as retaining rings 1532, 1534. In some embodiments, the shuttle 1500 comprises one or more bushings 1531, 1536 that are configured to reduce friction between the shuttle 1500 and the interior of the housing 1400. As shown in FIG. 11C, the shuttle 1500 can include one or more grooves 1541-1544 configured to receive the retaining rings 1532, 1534, bushings 1531, 1536, and/or gaskets 1533, 1535. In the illustrated embodiment, the shuttle 1500 includes grooves 1541-1544. In some embodiments, the gaskets 1533, 1535 provide a seal that inhibits or prevents liquids, gases, and/or particles from passing between the exterior of the shuttle 1500 and the interior of the housing 1400. In certain implementations, the gaskets 1533, 1535 inhibit or prevent pressurized fluids (e.g., at well pressure) from passing between the shuttle 1500 and the housing 1400. Some embodiments do not include gaskets (e.g., O-rings) on the outside of the shuttle, such as certain embodiments of the connector 100 described above.

Certain Additional Embodiments (FIGS. 12A-14B)

FIGS. 12A-14B are views of another embodiment of a connector 2100. In many respects, the connector 2100 is similar to the connector 100 described above. Certain similar aspects of the connector 2100 will not be described again here, with the understanding that similar features have been previously described with reference to the connector 100. Accordingly, components of the connector 2100 that are similar to the components of the connector 100 have been labelled with the addition of a numeral 2 as the first digit. Differences between the structures, materials, and functions of the connectors 2100 and 100 are otherwise described below.

The connector 2100 can be any type of connector, including an electrical connector, a hydraulic connector, a pneumatic connector, or other type of connector. In the illustrated embodiment of FIGS. 12A-14B, the connector 100 is an electrical connector. The connector 2100 extends along a longitudinal axis between a first end 2102 and a second end 2104. The connector 2100 can include an outer casing or housing 2400. The housing 2400 can be generally cylindrically shaped. A cable bundle 2020 extends into the housing 2400 through a first end 2402. The cable bundle 2020 can include one or more cables (e.g., insulated electrical wires). For example, the illustrated embodiment has three cables 2022, 2024, 2026 that extend into the housing 2400.

As shown, a receptacle assembly 2900 can be positioned at the second end 2104. A portion of the receptacle assembly 2900 can extend outwardly from the second end 2404 of the housing 2400. The receptacle assembly 2900 can include a socket 2902. The socket 2902 can be external to the housing 2400 and can be configured to receive a pin or plug on a corresponding electrical connector (not shown). For example, the receptacle assembly 2900 can include a male plug.

A sealing assembly 2300 can be positioned in the housing 2400. The sealing assembly 2300 can include a shuttle 2500 configured to move back and forth longitudinally along the longitudinal axis of the housing 2400. Some variants can comprise multiple shuttles 2500. The shuttle 2500 can include one or more set screws 2106. In the illustrated embodiment, two set screws 2106 are included. The set screws 2106 can extend partially through an opening or slot 2406 formed through the housing 2400 and into the shuttle 2500. When installed, the set screws 2106 may inhibit or prevent the shuttle 2500 from moving within the housing 2400. When removed, the set screws 2106 enable movement of the shuttle 2500 within the housing 2400 (e.g., with only the structures limitations of the housing 2400 and biasing member 2150). In various embodiments, the set screws 2106 are removed before or during use of the connector 2100. In some embodiments, one of the set screws 2106 can be removed to provide a configuration that partially limits the movement of the shuttle 2500 within the housing 4400. For example, in some embodiments, with only a single set screw 2106 installed, the movement of the shuttle 2500 is limited to approximately the length of the slot 2406.

The sealing assembly 2300 can include a sleeve 2700. In some embodiments, the sleeve 2700 is a substantially cylindrical tube. The sleeve 2700 can be similar to the sleeve 700 and can include or not include the grooves and o-rings 712, 714. The sleeve 2700 can include similar dimensions, features and structures described above in relation to the sleeve 700. In certain implementations, the sleeve 2700 is rigidly connected with the shuttle 2500. For example, the sleeve 2700 can be one component with the shuttle 2500 (e.g., integral with or monolithically formed with the shuttle 2500), or can be a separate component that is secured to the shuttle 2500 (e.g., press-fit into the shuttle 2500). In some embodiments, an inner end of the sleeve 2700 is located within a bore 2510 of the shuttle 2500 and an outer end of the sleeve 2700 extends therefrom. In certain implementations, the sleeve 2700 comprises a projection that extends longitudinally outwardly from the shuttle 2500. In some embodiments, gaskets, such as O-rings, are not positioned on and/or abutted against the sleeve 2700. The cable 2022 can extend through the bore 2510 and/or through a channel 2710 (e.g., a passage) of the sleeve 2700. The number of bores 2510 through the shuttle 2510 can correspond to the number of cables of the cable bundle 2020. In various embodiments, the shuttle 2500 and the sleeve 2700 move together longitudinally as a unit. In some embodiments, the shuttle 2500 and the sleeve 2700 are part of a sealing unit that moves relative to the stop component 2901.

The sealing assembly 2300 can include a support structure, such as a stop component 2901. The stop component 2901 can be a separate component of the receptacle assembly 2900 or formed integrally with the receptacle assembly 2900. A biasing member, such as a spring 2150, can bias the shuttle 2500 toward the stop component 2901. The shuttle 2500 and sleeve 2700 can be configured to move relative to the stop component 2901 and/or the housing 2400 (e.g., along the longitudinal axis of the connector 2100). The stop component 2901 can include an opening 2910 (e.g., a cavity, bore, passage, or otherwise) for receiving the cable 2022 therethrough. The number of openings 2910 can correspond to the number of cables of the cable bundle 2020. An end of the opening 2910 can include a shoulder 2911.

The sealing assembly 2300 can include a sealing boot 2600. The sealing boot 2600 can be configured to partially or completely fit within the opening 2910 of the stop component 2901. The sealing boot 2600 can comprise a generally cylindrical body extending between a first end and a second end, such as is illustrated above in FIGS. 6A-6B. The sealing boot 2600 can include dimensions, features, and structures described above in relation to the sealing boot 600. For example, the sealing boot 2600 can include a channel 2610 that extends through the body of the sealing boot 2600 between the first end and the second end and/or is configured to receive a cable therethrough. The sealing boot 2600 can include one or more inner diameters, outer diameters, ridges, and valleys, etc. (as described above and illustrated above in FIGS. 6A-6B). The number of openings 2910, sleeves 2700, and sealing boots 2600 can correspond to the number of cables in the cable bundle 2020. In various embodiments, the longitudinal length of the sealing boot 2600 increases as temperature increases and/or decreases as temperature decreases. The thermal expansion rate of the sealing boot 2600 can be greater than that of other components of the connector 2100, such as the stop component 2901. For example, the thermal expansion rate of the sealing boot 2600 can be at least about 10 times greater than the thermal expansion rate of the stop component 2901.

Figure 12A:
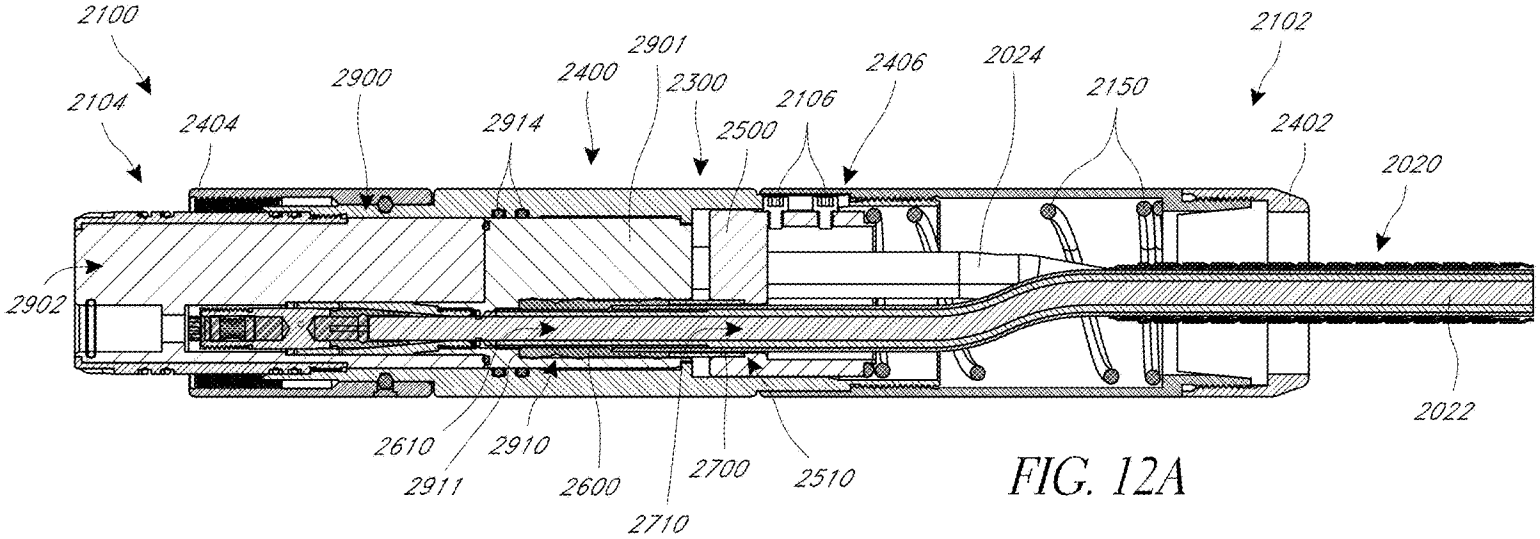
FIG. 12A is a longitudinal cross-sectional view of another embodiment of a connector in a first configuration.

The sealing boot 2600 can apply a sealing load to the cable. The sealing boot 2600 can be configured to deform (e.g., collapse or buckle), such as in the manner described above, within the opening 2910 of the stop component 2901. This can facilitate applying a sealing load around the cable and/or the opening 2910. For example, the deformation of the sealing boots 2600 can seal around the exterior of the cable and/or the interior of the opening 2910, thereby inhibiting or preventing pressure from escaping toward the second end 2104. In various embodiments, the amount of deformation of the sealing boot 2600 is a function of the position of the shuttle 2500 and/or the sleeve 2700 relative to the stop component 2901. As illustrated in FIG. 12A, the stop component 2901 can have a shoulder 2911 that an end of the sealing boot 2600 can rest and/or bear against. The sleeve 2700 and/or the shoulder 2911 can inhibit or prevent the sealing boots 2600 from being extruded out of position when exposed to a large pressure differential (e.g., at least about 800 psi). As illustrated, the cable can extend toward the second end 2104 through an aperture in the shoulder 2911. Various embodiments are designed to reduce and/or minimize radial space between the inside of the shoulder 2911 and the outside of the cable. Such a radial space can provide an extrusion gap through which the rubber boot can be deformed out of position (e.g., by pressure in the connector 2100), which can reduce sealing effectiveness and/or damage the sealing boot 2600. In some embodiments, the extrusion gap is less than or equal to about 0.010 in.

The sealing assembly 2300 can be configured to provide a seal around the cable 2022 over a wide range of temperatures and/or pressures. In some embodiments, the position of the shuttle 2500 moves to compensate for changes in temperature and/or pressure. As previously mentioned, in certain embodiments, the sleeve 2700 moves with and/or is a part of the shuttle 2500. In some embodiments, the sleeve 2700 engages (e.g., abuts and/or compresses) the sealing boot 2600 within the opening 2910. In some embodiments, as the position of the shuttle 2500 and/or sleeve 2900 moves, the sealing boots 2600 are compressed within the openings 2910 of the stop component 2901 by the sleeves 2700. As the sealing boots 2600 are compressed, the sealing boots 2600 can buckle or collapse around the cables, thereby forming a seal. In various embodiments, the sleeves 2700 have ends that are received in the stop component 2901 (e.g., in the opening 2910) and that engage (e.g., contact) the sealing boots 2600.

In some implementations, the position of the shuttle 2500 and/or the sleeve 2700 relative to the stop component 2901 is a function of the temperature of the connector 2100. For example, in some embodiments, shuttle 2500 and/or the sleeve 2700 moves toward the stop component 2901 as the temperature increases and/or moves away from the stop component 2901 as the temperature decreases. In certain embodiments, the amount of sealing provided by the sealing boot 2600 against the cable and/or the opening 2910 is a function of the temperature of the connector 2100. For example, in some embodiments, the amount of sealing provided by the sealing boot 2600 against the cable and/or the opening 2910 increases as the temperature increases and/or decreases as the temperature decreases. In various implementations, the amount of sealing provided by the sealing boot 2600 adjusts automatically in response to a change in temperature.

In some embodiments, the connector 2100 is configured to counteract the above-described difference in thermal expansion rate of the sealing boot 2600 and surrounding components, such as the stop component 2901. For example, in a situation in which the connector 2100 goes from a higher temperature or pressure to a lower temperature or pressure, the sealing boot 2600 reduces in length and/or volume more than the surrounding components. Normally, this would cause a problem maintaining a seal, such as when the connector is brought down to a pressure of less than or equal to about 50 psi. The connector 2100 can mitigate or avoid this problem. For example, the sleeve 2700 can move to counteract the relative difference in thermal expansion rates, thereby energizing the sealing boot 2600 and maintaining the seal. In some embodiments, the sealing problem is caused by a radial interference reduction. The connector 2100 can restore the radial interference by pushing on the sealing boot 2600 via the spring-biased shuttle 2500 and/or sleeve 2700. In certain embodiments, the sealing is largely dependent on the amount of radial interference. The amount of radial interference can be a function of the load applied to the sealing boot 2600, such as by ambient pressure and/or of spring 2150.

In various implementations, the sealing boot 2600 is self-energizing via pressure in the connector 2100. For example, the sealing boot 2600 can be energized by pressure in the first end 2102 of the connector 2100, such as in a chamber that houses the spring 2150 and/or shuttle 2500. The pressure can act on the sealing boot 2600 to energize (e.g., compress) the sealing boot 2600 toward the second end 2104. As the pressure in the first end 2102 increases (e.g., relative to the pressure in the second end 2104), the sealing load provided by the sealing boot 2600 around the cable and/or the opening 2910 can increase. In some embodiments, the pressure in the chamber provides the primary energizing force on the sealing boot 2600 when the connector 2100 is subjected to higher pressures and/or temperatures, such as at least about 50 psi and/or at least about 200° F. In some embodiments, the spring-biased shuttle 2500 provides the primary energizing force on the sealing boot 2600 when the connector 2100 is subjected to lower pressures and/or temperatures, such as less than or equal to about 50 psi and/or less than or equal to about 200° F.

In some implementations, the sealing boot 2600 provides a plurality of sealing regions along the length of engagement between the sealing boot 2600 and the cable. A plurality of sealing regions can reduce the chance of leakage even if one or more of the sealing regions is breached. In certain embodiments, compared to an o-ring, for example, the sealing boot 2600 provides an extended length of sealing around the cable. In some embodiments, the extended length of the sealing boot 2600 can reduce the chance of damage to the insulation of the cable, such as by distributing the force applied by the sealing boot 2600 to the cable across a larger area. In certain embodiments, in an uncompressed state the longitudinal length of the sealing boot 2600 is greater than or equal to the longitudinal length of the sleeve 2700 and/or the shuttle 2500. In some variants, the ratio of the longitudinal length of the sealing boot 2600 in an uncompressed state to the outside diameter of the cable (including the insulation) is at least about: 3, 4, 5, 6, 7, or more.

Figure 12B:
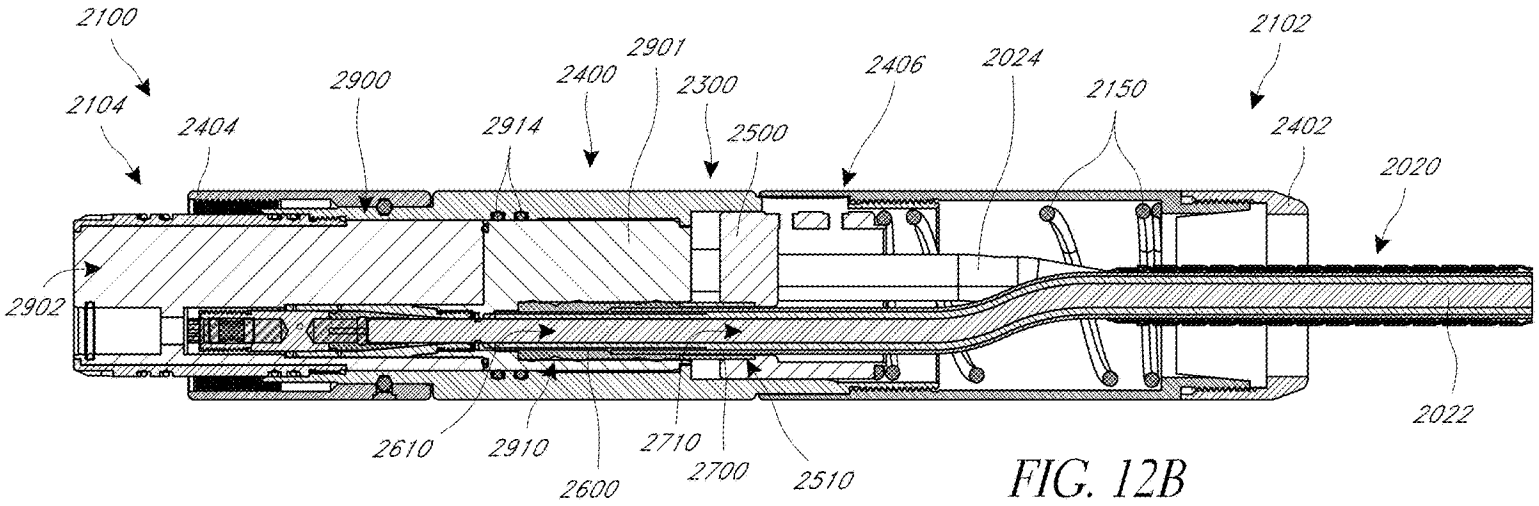
FIG. 12B is a longitudinal cross-sectional view of the embodiment of FIG. 12A in a second configuration.

FIG. 12A is a longitudinal cross-sectional view of the connector 2100 in one state, such as a partially compressed configuration of the sealing assembly 2300. The shuttle 2500 is biased towards the stop component 2901. The sleeve 2700 is engaged with the sealing boot 2600, the sealing boot 2600 being at least partially compressed within the opening 2910. In some implementations, the outer end of the sleeve 2700 is inserted within the opening 2910 and engaged therein with the sealing boot 2600. FIG. 12B is a longitudinal cross-sectional view of the connector 2100 in another state, such as an uncompressed (or less compressed) configuration compared to FIG. 12A. As shown, the set screws 2106 have been removed which can allow further movement of the shuttle 2500 and compression or decompression of the sealing boot 2600. As illustrated, the shuttle 2500 and sleeve 2700 have moved away from the boot 2600, thereby allowing the boot 2600 to expand relative to FIG. 12A. In some implementations, FIG. 12B illustrates an example in which the connector 2100 is at a lower temperature and/or pressure compared to FIG. 12A.

The inner core or stop component 2901 can include certain features that can provide a seal against the interior of the housing 2400. For example, as illustrated, the stop component 2901 can include one or more gaskets (e.g., O-rings) 2914. The gaskets 2914 can be retained by one or more retaining units, such as retaining rings. In some embodiments, the gaskets 2914 provide a seal that inhibits or prevents liquids, gases, and/or particles from passing between the exterior of the stop component 2901 and the interior of the housing 2400. In certain implementations, the gaskets 2914 inhibit or prevent pressurized fluids (e.g., at well pressure) from passing between the stop component 2901 and the housing 2400. Some embodiments do not include gaskets (e.g., O-rings) on the outside of the stop component 2901. In some implementations, the stop component 2901 is formed integrally with or mechanically fastened with the housing 2400 in a manner that inhibits or prevents leakage between the two (e.g., press fit or forging).

Figure 13:
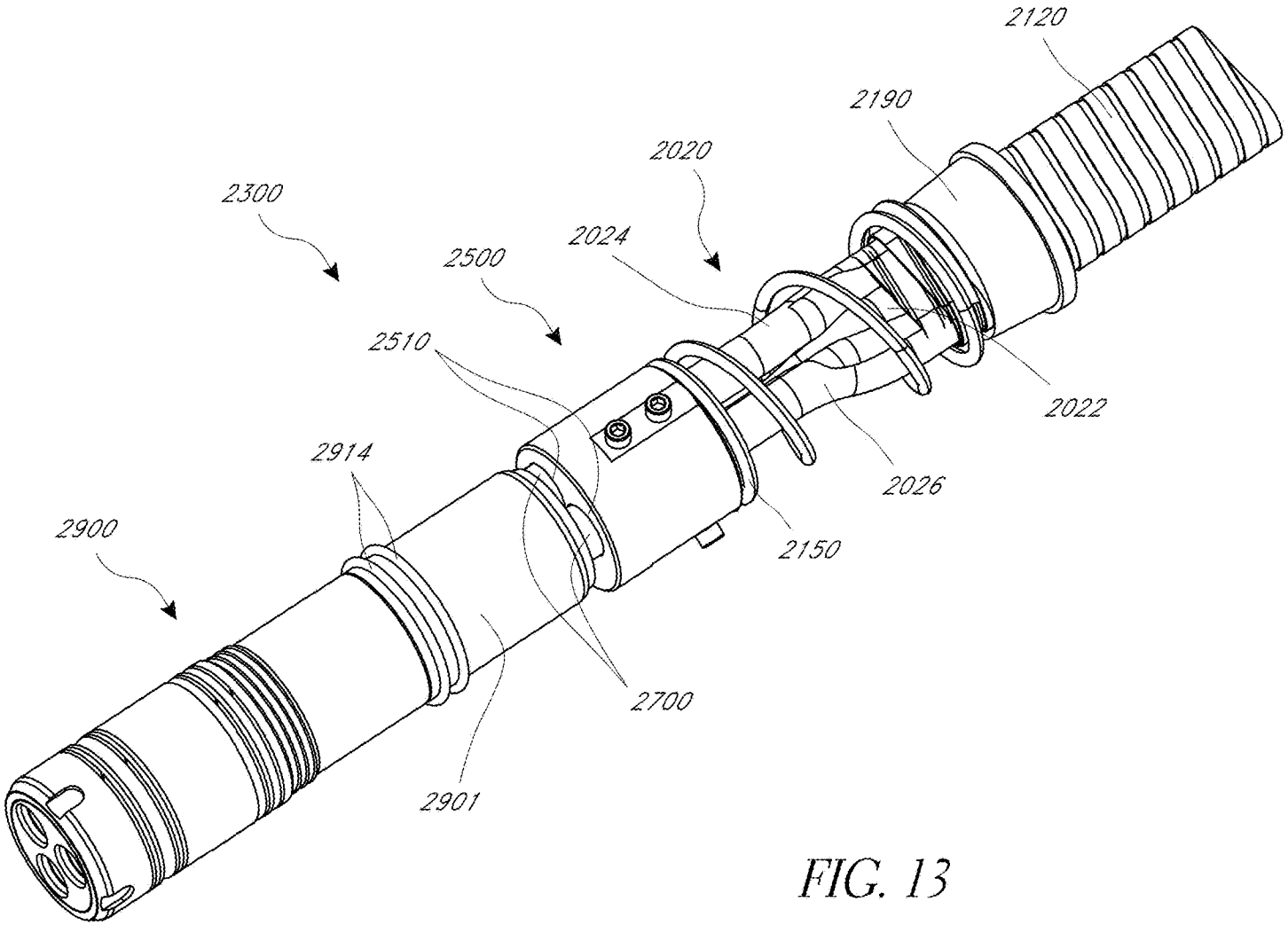
FIG. 13 is an isometric view of the embodiment of FIG. 12A illustrated with a housing removed.

FIG. 13 illustrates the connector 2100 with the housing 2400 removed to show certain of the internal components of the sealing assembly 2300. The three cables 2022, 2024, 2026 extend into the connector 2100 through a ferrule 2190 having one or more apertures for receiving the individual cables or the cable bundle 2020. The three cables 2022, 2024, 2026 can extend through the spring 2150 and into three corresponding bores 2510 of the shuttle 2500. The three cables 2022, 2024, 2026 can extend into three sleeves 2700 corresponding to the bores 2510. The spring 2150 can bias the shuttle 2500 toward and/or against the stop component 2901. For example, the outer ends of the sleeves 2700 can be inserted into openings 2910 (FIGS. 12A, 12B) of the stop component 2901 that correspond to the sleeves 2700. The three cables 2022, 2024, 2026 can extend through corresponding openings 2910. The outer ends of the sleeves 2700 can contact and compress sealing boots 2600 (FIGS. 12A, 12B) disposed correspondingly within the openings 2910. The force from the biasing member 2150 can compress or buckle the sealing boots 2600 around the cables 2022, 2024, 2026 thereby providing a seal through the stop component 2901. The gaskets 2914 can provide a seal between the housing 2400 (not shown) and the stop component 2901.

Figure 14A:
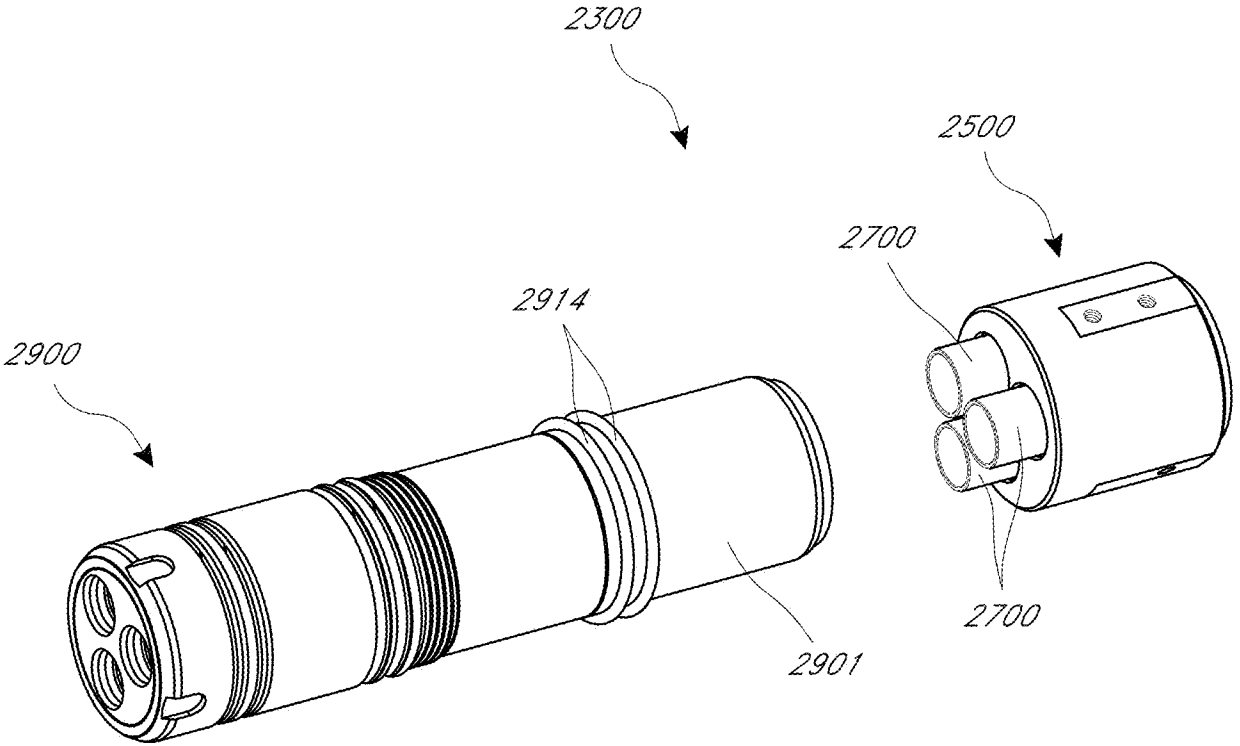
FIG. 14A is an isometric exploded view of certain components of the embodiment of FIG. 12A.
Figure 14B:
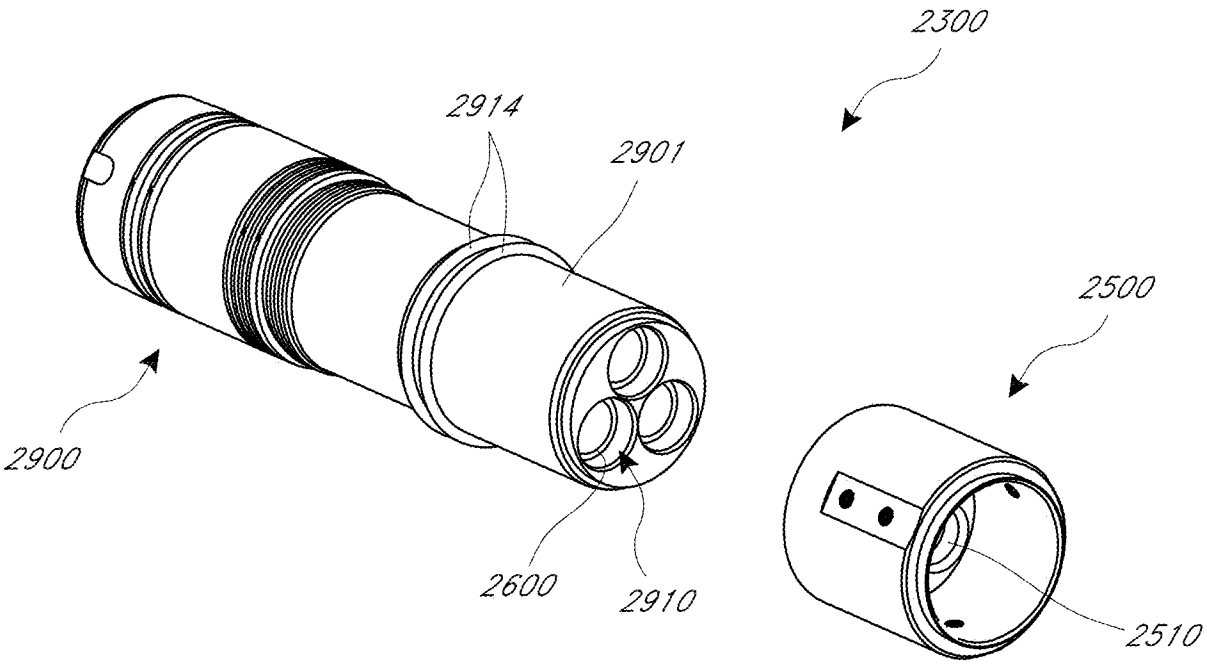
FIG. 14B is another isometric exploded view of certain components of the embodiment of FIG. 12A.

FIGS. 14A-14B illustrate an example of the sealing assembly 2300. As shown, in some embodiments, the assembly 2300 includes a plurality (such as two, three, or more) sleeves 2700 that correspond to the number of openings 2910 of the stop component 2901. The openings 2910 can extend into the stop component 2901 with the sealing boots 2600 disposed therein. In certain implementations, the shuttle 2500 can include one or more grooves, retaining rings, bushings, and/or gaskets (similar to grooves 1541-1544, retaining rings 1532, 1534, bushings 1531, 1536, and gaskets 1533, 1535 described above in relation to shuttle 1500). The grooves, retaining rings, bushings, and/or gaskets can provide a seal that inhibits or prevents liquids, gases, and/or particles from passing between the exterior of the shuttle 2500 and the interior of the housing 2400.

The connector 2100 can provide a different sealing configuration than the connector 100. For example, in certain implementations of the connector 100, the sealing boot 600 is positioned within the shuttle 500. The sealing boot 600 seals around the cable 22 and an additional seal is formed between the stop component 800 and the sleeve 700. This additional seal can be achieved in various ways, such as with one or more gaskets (e.g., using O-rings 714) located between an outside of the sleeve 700 and an inside of the stop component 800, as illustrated in FIG. 1B. The combination of the sealing boot 600 and the additional seal can inhibit or prevent pressure leakage in the direction toward the second end 2104. In the connector 2100, the sealing boot 2600 is disposed within the opening 2910 of the stop component 2901. In certain implementations, the sleeve 2700 does not have gaskets, such as between the sleeve 2700 and the shuttle 2500. In some embodiments, the sealing boot 2600 provides the primary and/or sole seal around the cable 2020 and/or against the walls of the opening 2910 to inhibit or prevent pressure leakage in the direction toward the second end 2104. This can increase the reliability and/or sealing performance of the connector 2100, reduce the number of parts in and the complexity of the connector 2100, and/or reduce cost.

In a controlled environment, ten samples of the connector 2100 illustrated in FIGS. 12A and 12B were tested. The samples were exposed to a mixture of water, diesel, and nitrogen gas. The samples were subjected to a temperature of about 500° F. and a pressure differential (between the first end 2102 and the second end 2104) of about 800 psi. The samples were maintained at this temperature and pressure for about 9 days. Each of the samples were observed to prevent pressure from leaking through the second end of the connector and to not suffer any electrical failures.

Certain Terminology

Although systems, devices, and methods of the connectors have been disclosed in the context of certain embodiments and examples, it will be understood by those skilled in the art that the assemblies extend beyond the specifically disclosed embodiments to other alternative embodiments and/or uses of the embodiments and certain modifications and equivalents thereof. Use with any structure is expressly within the scope of this invention. Various features and aspects of the disclosed embodiments can be combined with or substituted for one another in order to form varying modes of the assembly. The scope of this disclosure should not be limited by the particular disclosed embodiments described herein.

Certain features that are described in this disclosure in the context of separate implementations or embodiments can also be implemented in combination in a single implementation or embodiment. Conversely, various features that are described in the context of a single implementation or embodiment can also be implemented in multiple implementations or embodiments separately or in any suitable subcombination. Moreover, although features may be described above as acting in certain combinations, one or more features from a claimed combination can, in some cases, be excised from the combination, and the combination may be claimed as any subcombination or variation of any subcombination.

Terms of orientation used herein, such as "top," "bottom," "proximal," "distal," "longitudinal," "lateral," and "end," are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Some embodiments have been described in connection with the accompanying drawings. The figures may be to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

SUMMARY

In summary, various embodiments and examples of systems, devices, and methods of connectors have been disclosed. Although these have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

The following is claimed:

1. An electrical connector comprising:

a housing comprising a longitudinal axis;

a sealing assembly positioned in the housing, the sealing assembly comprising:

a stop component having a bore extending therethrough and a shoulder, the stop component fixedly positioned in the housing;

a shuttle configured to move relative to the stop component along the longitudinal axis;

a sleeve projecting from the shuttle, the sleeve extending between a first end and a second end, the sleeve configured to move with the shuttle as a unit;

a spring positioned in the housing, the spring biasing the shuttle towards the stop component; and a sealing boot comprising a first end, a second end, and a channel, the sealing boot positioned in the bore of the stop component, the first end of the sealing boot abutted against the shoulder of the stop component, the second end of the sealing boot configured to abut against the first end of the sleeve, wherein the sealing boot is configured to receive a cable through the channel and to form a seal around the cable by applying a sealing load around the cable, the sealing boot configured to buckle in response to the shuttle moving toward the stop component, thereby increasing the sealing load around the cable.

2. The connector of claim 1, wherein the sleeve further comprises an aperture, the aperture configured to receive the cable therethrough, wherein the cable can pass through the sleeve and the shuttle.

3. The connector of claim 1, wherein an outer surface of the sealing boot comprises one or more ridges and one or more valleys.

4. The connector of claim 1, wherein, when the sealing boot buckles, an inner diameter of the channel of the sealing boot decreases.

5. The connector of claim 4, wherein, when the sealing boot buckles, an outer diameter of the sealing boot increases.

6. The connector of claim 1, wherein the longitudinal length of the sealing boot decreases as the shuttle moves toward the stop component.

7. The connector of claim 1, wherein, when the shuttle moves along the longitudinal axis towards the stop component, the first end of the sleeve is received within the bore of the stop component.

8. The connector of claim 1, wherein the connector is configured such that the shuttle moves toward the stop component in response to an increase in ambient temperature.

9. The connector of claim 1, wherein the second end of the sleeve is positioned in a cavity in the shuttle.

10. A connector for providing a seal around a cable, the connector comprising:

a support structure comprising an opening;

a movable shuttle having a bore extending therethrough, the bore configured to receive the cable, the shuttle configured to move relative to the support structure;

a sealing boot having a channel extending therethrough, the channel configured to receive the cable, the sealing boot positioned within the opening of the support structure, the sealing boot configured to collapse when compressed along a longitudinal axis; and a sleeve having an aperture extending therethrough, the aperture configured to receive the cable, the sleeve extending outward from the shuttle and moveable with the shuttle, the sleeve configured to be at least partially received in the opening of the support structure and to contact the sealing boot, wherein, when the sealing boot is compressed and collapses, a length of the sealing boot measured along the longitudinal axis decreases and an inner diameter of the channel of the sealing boot decreases.

11. The connector of claim 10, wherein the sealing boot comprises an elastomeric material.

12. The connector of claim 10, wherein the sealing boot is configured to provide an amount of sealing around the cable that is a function of the position of the shuttle relative to the support structure.

13. The connector of claim 10, wherein, when the sealing boot is compressed and collapses, an outer diameter of the sealing boot increases.

14. The connector of claim 10, wherein the opening includes a shoulder, and wherein a first end of the sealing boot abuts against the shoulder.

15. The connector of claim 14, wherein a first end of the sleeve extends into the opening and abuts against a second end of the sealing boot, and wherein the sealing boot is compressed between the shoulder and the first end of the sleeve as the shuttle moves towards the support structure.

16. The connector of claim 10, wherein a length of the sealing boot is less than a length of the opening such that the entire sealing boot is positioned within the opening.

17. The connector of claim 10, further comprising a spring that biases the shuttle towards the support structure.

18. The connector of claim 10, wherein the sleeve is monolithic with the shuttle.

19. A method of sealing an electrical cable, the method comprising:

receiving a first pressure on a first end of a moveable shuttle of an electrical connector;

receiving a second pressure on a second end of the shuttle, the second pressure being about equal to the first pressure;

biasing the shuttle with a biasing member;

at least partly in response to the bias of the biasing member, moving the shuttle and a sleeve extending therefrom within a housing of the electrical connector and towards a support structure of the electrical connector;

compressing a sealing boot that is positioned within an opening of the support structure, wherein compressing the sealing boot comprises compressing the sealing boot between a shoulder of the support structure and an end of the sleeve that is positioned within the opening;

buckling the sealing boot; and adjusting a sealing load around the cable in response to the buckling of the sealing boot.

20. The method of claim 19, further comprising increasing an outside diameter of the sealing boot.

21. The method of claim 19, wherein adjusting the sealing load around the cable in response to the buckling of the sealing boot comprises increasing the sealing load around the cable in response to an increase in ambient temperature.

22. The method of claim 19, wherein the biasing member comprises a helical spring.

* * * * *